US007653953B2

(12) United States Patent
Lopez-Sansalvador

(10) Patent No.: US 7,653,953 B2
(45) Date of Patent: Feb. 2, 2010

(54) ROTATING THERAPEUTIC BED

(75) Inventor: Rodrigo Lopez-Sansalvador, Querétaro (MX)

(73) Assignee: CIATEQ, A.C., Qro. Qro. (MX)

( * ) Notice: Subject to any disclaimer, the term of this patent is extended or adjusted under 35 U.S.C. 154(b) by 403 days.

(21) Appl. No.: 10/589,488

(22) PCT Filed: Feb. 16, 2005

(86) PCT No.: PCT/IB2005/000387

§ 371 (c)(1),
(2), (4) Date: Sep. 11, 2006

(87) PCT Pub. No.: WO2005/082307

PCT Pub. Date: Sep. 9, 2005

(65) Prior Publication Data

US 2007/0174966 A1 Aug. 2, 2007

(30) Foreign Application Priority Data

Feb. 17, 2004 (MX) ..... PA/A/2004/001513

(51) Int. Cl.
*A61G 7/008* (2006.01)

(52) U.S. Cl. ..... 5/607; 5/609; 5/612

(58) Field of Classification Search ..... 5/600, 5/607, 609, 611, 612
See application file for complete search history.

(56) References Cited

U.S. PATENT DOCUMENTS 1,780,399 A 11/1930 Munson
1,990,357 A * 2/1935 Ward ..... 5/607
2,188,592 A * 1/1940 Hosken et al. ..... 5/607
3,238,539 A * 3/1966 Koch ..... 5/607
3,757,129 A * 9/1973 Hogan ..... 5/601
3,827,089 A 8/1974 Grow
4,244,358 A 1/1981 Pyers
4,937,901 A * 7/1990 Brennan ..... 5/607
5,020,170 A * 6/1991 Ruf ..... 5/607

(Continued)

FOREIGN PATENT DOCUMENTS

GB 2039731 A * 8/1980

(Continued)

*Primary Examiner*—Michael Trettel
(74) *Attorney, Agent, or Firm*—The Nath Law Group; Jerald L. Meyer; Sungyeop Chung

(57) ABSTRACT

It is depicted a rotating therapeutic bed which comprises: a structural base including in turn wheels located on its lower portion to allow moving the bed from one place to another; a first removable stretcher with a first mattress to support the patient laying on his back; a second removable stretcher with a second mattress being placed in a reversed fashion and over the first stretcher and the patient, who is supported between the mattresses of both stretchers; the second stretcher supporting the patient laying face down when stretchers are rotated by 180° on a rotation axis crossing along the patient; front and rear stretcher mounting and rotation members rotationally mounted on the structural base; the first and second stretchers being longitudinally mounted with a vertical spacing between them in such stretcher mounting and rotation means, which allow also their rotation; and side barriers coupled to the longitudinal sides of the first stretcher, as well as of the second stretcher, such barriers covering the vertical spacing between such stretchers where the patient is laying, preventing the patient's limbs from protruding from stretchers when they are rotated.

49 Claims, 22 Drawing Sheets

U.S. PATENT DOCUMENTS

| | | | | |
|---|---|---|---|---|
| 6,701,553 | B1 * | 3/2004 | Hand et al. | 5/600 |
| 7,343,635 | B2 * | 3/2008 | Jackson | 5/611 |
| 2002/0138906 | A1 | 10/2002 | Bartlett et al. | |
| 2007/0113336 | A1 * | 5/2007 | Sharps | 5/81.1 R |
| 2007/0174966 | A1 * | 8/2007 | Lopez-Sansalvador | 5/607 |

FOREIGN PATENT DOCUMENTS

| | | | |
|---|---|---|---|
| WO | 97/22323 | A1 | 6/1997 |
| WO | 99/62454 | A1 | 12/1999 |

* cited by examiner

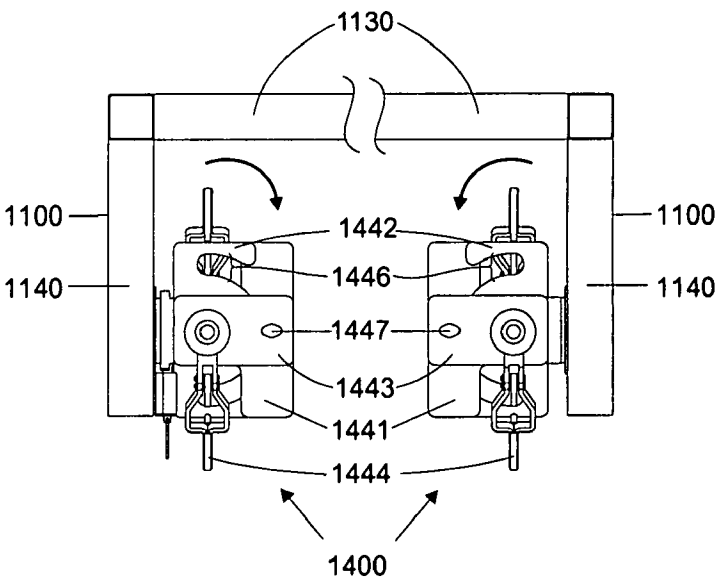
FIG. 8A
FIG. 8B
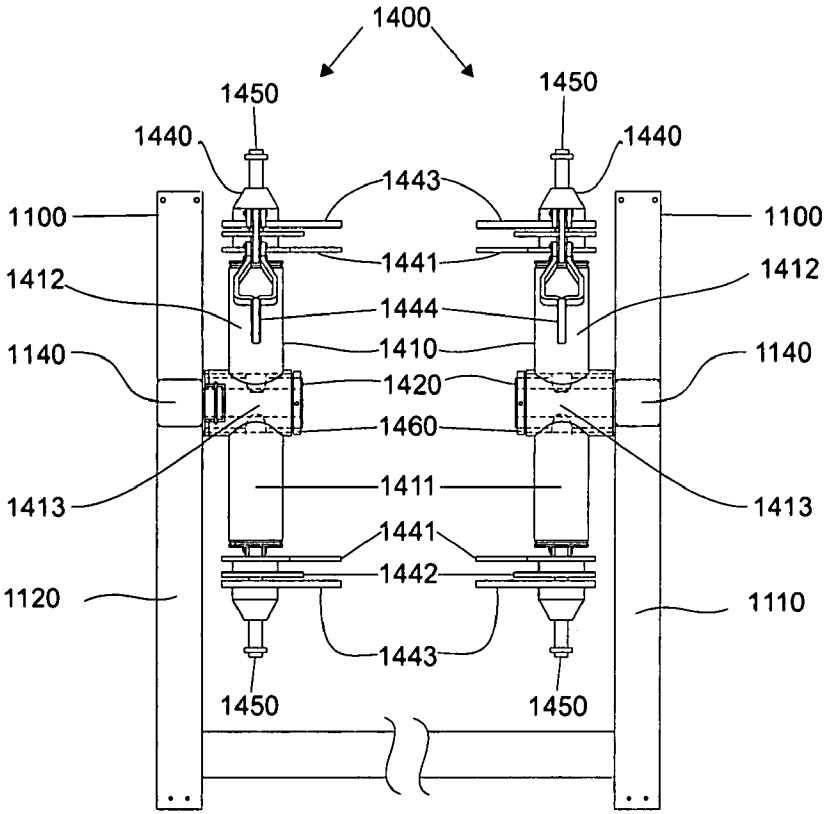
FIG. 7A
FIG. 7B

ROTATING THERAPEUTIC BED

FIELD OF THE INVENTION

The present invention relates to the techniques used in designing and manufacturing devices and apparatuses for therapeutic and medical use employed for the treatment of people suffering from partial or temporary paralysis and, more particularly, it relates to a rotating therapeutic bed.

BACKGROUND OF THE INVENTION

In modern society, there is a series of accidents that takes place often. In developed societies, accidents related to car traffic are one of the main causes of death. Likewise, many people who make it to survive those traffic accidents partially or fully lose their body motility control due to the injuries resulting from the abovementioned traffic events.

In addition to accidents, whether they are car traffic ones or not, there are other causes resulting in the loss of voluntarily moving some part of one's body. Such causes may be an illness or injury at any points along the motor nerve system between the brain and the muscle fibers, which may arise from injury, poisoning, infection, hemorrhage, occlusion of blood vessels, or tumors, where paralysis may be temporary or permanent.

Temporary paralysis, also known as paresis, often results from infections, traumas, or toxic substances which suppress for a while the motor activity, but do not result in serious injury of nerve cells. On the other hand, permanent paralysis results from extended injury in nerve cells or a nerve root, where nerve cells being seriously injured cannot regenerate. Paralysis of one limb is called monoplegia; paralysis of both limbs at the same side is called hemiplegia; paralysis of both lower limbs is called paraplegia or diplegia; and paralysis of the four limbs is called quadriplegia or tetraplegia.

The United States is known to have a total of about 250,000 permanent quadriplegic patients and its number increases at a rate of 10,000 cases per year. Likewise, according to data from the last general population census, Mexico has about 814,000 people having problems of motor disability.

The immovability of quadriplegic patients makes them to be most of the time laying on a bed and they are thus at risk of developing eschars and sores on their skin, since their immovability prevents them from moving their body and place them in a different position as often as normal people may do so. In this sense, the best to avoid the appearance of eschars and sores is to change the position of the patient in bed, in particular to initially place the patient lying on his back and then turn the patient face down and alternately changing the patient position in periods of time of at least four hours. An important aspect to be considered in this 180° position change is the safety that must be kept to avoid generating additional injuries to the patient.

Thus, in the state of the art, therapeutic beds have been developed to provide such a position change, such as the one depicted in the International Patent Application No. PCT/IE96/00087, published under number WO 97/22323, which depicts a therapeutic bed comprising a support-frame with wheels and a Trendelenburg position support-frame (where feet are located in a plane more elevated than the head) including curved arms that are mounted on guide wheels of the support-frame with wheels. The Trendelenburg position support frame has also guide wheels on which there are rings located in opposing ends of the bed. Likewise, a patient support platform is mounted on the rings, such platform including a mattress and leg supports. Furthermore, the bed includes side rails that are engaged and fastened to the patient support platform. Every side rail incorporates support means for the patient laying face down, the means comprising a head support, an adjustable abdomen support, and sections of support cushions which are longitudinally separated to define adjustable support parts that are mounted so that they can move as a hinge or blade, be engaged, and fastened.

The therapeutic bed provides the patient with a position in which he lies face down by means of the 180° rotation of the rings mounted on the guide wheels. Likewise, the bed may be used for kinetic therapy and/or Trendelenburg movement when a patient is laying face down.

This bed has a quite complicated design, since one of its objects is to be used in the treatment of patients having respiratory problems, being thus only used in hospitals and being operated exclusively by qualified personnel, which is a disadvantage when the bed is used for quadriplegic patients who, most of the times, are at their own home and are directly taken after by their relatives. Therefore, there is a need for beds having a simpler operation and construction which, however, are also provided with safety systems allowing to perform the patient 180° position change in a safely manner.

In particular, it is desirable to have beds where none of the patient limbs are hanging or protruding form the bed when performing the patient position change. Furthermore, beds must not have protuberances or projections that may prove dangerous when the patient position is changed. These are very important aspects to be considered when selecting a bed for quadriplegic patients or patients suffering from motor disability problems.

On the other hand, when a person is suspected to have an injury in the backbone and/or spinal cord, the patient is immobilized and subjected to a therapy known as cervical traction, which aims to keep the patient backbone straight. For that purpose, the patient's head is horizontally pulled by using a free weight hanging from the bed and, in particular, a diadem is placed on the patient and a string is attached to it, whose other end has a free weight which hangs from it. The cervical traction is also a recovery therapy applied in several cases (vertebral listhesis).

For the cases mentioned in the preceding paragraph, it is desirable that the patient position change is performed in a safely manner without ceasing to apply the cervical traction to it. It is worth mentioning that the bed depicted in document WO 97/22323 does not mentioned any means by which the cervical traction therapy may be performed.

Likewise, the operation of the previously depicted bed may represent a complex task for one person alone, since it is necessary to make a considerable effort to place on the patient the cushions which support him in a position in which he lies face down and which are adjusted and secured by using strings to rotate then the rings allowing to perform the 180° rotation.

Regarding the above, it is important bearing in mind the fact that the patient is laying face down and supported only by the cushions, which do not provide a support such as firm as when the patient is laying on his back and is supported by the platform. Furthermore, the safety of the patient laying face down may be reduced in this bed if the strings had not been properly stretched.

Another disadvantage that may be found in the bed depicted in the International Application No. PCT/IE96/00087 is the one related to the limited access to the patient when he is laying face down. In particular, with such bed there is only access to the patient's back when he is in such a position, since the support platform makes the access to the patient difficult, since it is securely fixed on the rings. In this sense, it is desirable to have an easy, rapid, and total access to the patient body when he is laying face down and even on his back. A total access facilitates taking care of the quadriplegic patients or patients suffering from motor disability.

On the other hand, in the prior art there is the bed depicted in the Patent International Application No. PCT/IE99/00049, published under number WO 99/62454, which shows improvements with respect to the bed depicted in International Publication No. WO 97/22323, such improvements being mainly focused to two issues, namely: 1) providing means for care lines directed to patients suffering from severe respiratory problems; and 2) providing the safety needed to rotate the patient.

Regarding the bed depicted in the Application No. PCT/IE99/00049, it can be mentioned that such a bed is to be used mainly in hospitals and, furthermore, it continues to show problems with respect to the limited access to patients when they are laying face down. In spite that the patient support platform provides panels that can be moved as a hinge or blade on a transversal central bar included in the platform to have access to the patient, such an access is partial and only towards the patient's back. Regarding safety, the bed of such a document provides in particular retention means to detachably fastening a patient to the support platform, such support means being operatively attached to the actuating means ruling the rotation of the patient support platform so that, if the retention means are in a proper position, the rotation is allowed. In order to achieve the above, the document mentions the inclusion of sensor in the clasps and strings indicating if the parts have been properly coupled.

Finally, in the state of the art there is a bed depicted in the US Patent Application Serial No. US 2002/0138906 A1, which is extremely similar to that described in the Application No. PCT/IE99/000049. The bed depicted in such US application incorporates improvements related to providing at the rotating rings a section that may be disassembled, sensors indicating if the strings are stretched enough, as well as providing side rails facilitating the access to the patient. In other words, such a document improves in certain aspects the functionality of the bed. However, it continues to have a design that it is mainly directed to be used in hospitals.

The bed depicted in the US Patent Application Serial No. US 2002/0138906 A1 more particularly comprises: A base frame, a platform to support the patient which is rotationally mounted on the base frame for a rotational movement around a longitudinal axis, an actuating system to rotate the patient support platform on the base frame, an end ring straightened up at the bed head board having a central opening to carry lines to take care of the patient, and a removable upper section to improve access to the patient's head. The patient support platform preferably has rotationally mounted side rails which are bent under the patient bed, as well as strings with string connectors indicating if the strings are stretched enough. A direct wired electric connection between the patient support platform and the base frame allows the full rotation of the patient in any direction. Furthermore, it includes a lever manually operated which disengages the patient platform from the actuating system to allow the manual rotation of the patient platform.

According to the above, in such a bed the patient is supported by a series of cushions that are fastened by means of strings incorporating sensors to indicate if such strings are stretched enough. However, as any electromagnetic device, there is the risk for failures in sensors, which would result in a full failure of the safety system.

As it may be seen, the beds depicted in the three above-mentioned documents share a very similar structure, which is complex and bulky, mainly because the base with wheels is basically formed by a horizontal rectangular frame provided with various elements in order to provide the "Trendeleburg" position and provide support to the guide rings and, furthermore, the rings mounted at the bed head and foot are also very bulky.

In this sense, it is appropriate that a bed for these patients is not very bulky and, furthermore, that it may be easily assembled and disassembled by one single person, although the beds from the previous art do not consider any of these features. A bed having elements that can be easily disassembled would provide countless advantages to these patients, mainly regarding their relocation and hygiene. More particularly, it is appropriate that the platform providing support to the patient is rapidly removed from the bed and relocate the patient on it. However, the beds from the previous art do not allow this possibility.

Furthermore, it is desirable to have a bed not only allowing the patient to rotate, but providing also the patient with comfort. In particular, beds must be adjustable for height and inclination (Trendelenburg position), have an adjustable tilted back support in order for the patient to seat and have food, and it must be designed in order to conduct lines to provide saline solution to the patient or lines for providing other medical care, without these lines interfering with the operation of rotating the patient.

Moreover, it is desirable to have a bed in which various devices may be used, such as bedpans in order for the patient to evacuate. Considering that the patient is laying face down for long periods of time, the bed must have a window or space which represents no obstruction of the patient's visual field, in order for him to be able to read books or watch television screens.

Another important issue in these beds is that the lowest possible force is needed to change the patient position by a 180° turn, while in the beds from the previous art such a turn was achieved by means of electric motors. However, as it has been mentioned in this chapter, it is desirable to have a bed where one single person may be able to perform the turn and, furthermore, without the need of using electric motors. The above is considering that this rotation operation is a repetitive one.

Likewise, another disadvantage of the beds from the previous art is that, since they include electric or electromagnetic components, they cannot be in contact with water and thus patients need to be relocated in other devices for bath. It is therefore desirable to have a bed in which patients may have a bath on the bed itself.

As it may also be seen, the beds from the previous art, due to their design and use in hospitals, are considerably expensive and they are thus not affordable by families of developing countries, such as Mexico, where an important percentage of the population has low income and quadriplegic relatives.

Consequently, the disadvantages from therapeutic beds in the state of the art have been pretended to be overcome by developing a therapeutic rotationally bed having an extremely simple and economical construction, but having a design allowing a person to change the patient position by means of a 180° turn of the patient in an easy but above all safe fashion. The bed from the present invention eliminates the use of strings to fasten the patient when he is laying face down. However, for this position, it provides a firm support, such as when the patient is laying on his back. The bed of the present invention is integrated by elements which can be rapidly disassembled and facilitate a full access to the patient when he is laying on his back or face down, so that he is able to be provided with all the needed care. Likewise, the bed of the present invention has a not very bulky base allowing its movement through narrow corridors and, above all, it has a design allowing it to be used at home, as well as in hospitals. The inner part of the base has means allowing the provision of the Trendelenburg position.

OBJECTS OF THE INVENTION

Considering the defects of the previous art, it is an object of the present invention to provide a rotating therapeutic bed having an extremely simple, practical, and economical construction and being also highly effective to change the position of a patient from being laying on his back to being laying face down by means of turning him 180°, such rotationally movement being performed in a very easy fashion but, above all, with the greatest safety to prevent the patient from suffering injuries.

An additional object of the present invention is to provide a therapeutic bed from which no patient's limb protrudes from the bed when the patient itself is turned around.

Yet another object of the present invention is to provide a rotating therapeutic bed on which the patient is firmly supported by a platform or stretcher when he is laying face down.

Yet another object of the present invention is to provide a rotating therapeutic bed allowing full access to the patient when being laying face down.

Yet another object of the present invention is to provide a rotating therapeutic bed including rotation-blocking means preventing the bed from rotating when it is partially disassembled.

Yet another object of the present invention is to provide a rotating therapeutic bed whose main components may be easily removed.

Yet another object of the present invention is to provide a rotating therapeutic bed whose base allows the handling of the bed throughout narrow corridors.

Yet another object of the present invention is to provide a rotating therapeutic bed allowing the patient to receive a bath on the bed itself.

Yet another object of the present invention is to provide a rotating therapeutic bed not including any type of electric or electronic components that may be damaged when the patient receives a bath.

Yet another object of the present invention is to provide a rotating therapeutic bed on which, when the patient is laying face down, has a free visual field to read books or watch television screens.

Yet another object of the present invention is to provide a rotating therapeutic bed designed to connect the patient to means and lines allowing to carry out the patient's cervical traction operation or allowing to provide saline solution to the patient, without those means or lines interfering with rotating the patient.

BRIEF DESCRIPTION OF THE FIGURES

The innovative aspects considered to characterize the present invention will be established with more detail in the appended claims. However, due both to its organization and operation method, the invention itself, along with other objects and advantages of the same, will be better understood by reading the following detailed description of a certain embodiment in connection to the appended drawings, wherein:

FIG. 7A is a top side view of the rear stretcher mounting and rotation member shown in FIG. 6A.

FIG. 7B is a top side view of the front stretcher mounting and rotation member shown in FIG. 6B.

FIG. 8A is a top plan view of the rear stretcher mounting and rotation member shown in FIG. 6A.

FIG. 8B is a top plan view of the front stretcher mounting and rotation member shown in FIG. 6B.

DETAILED DESCRIPTION OF THE INVENTION

Figure 1:
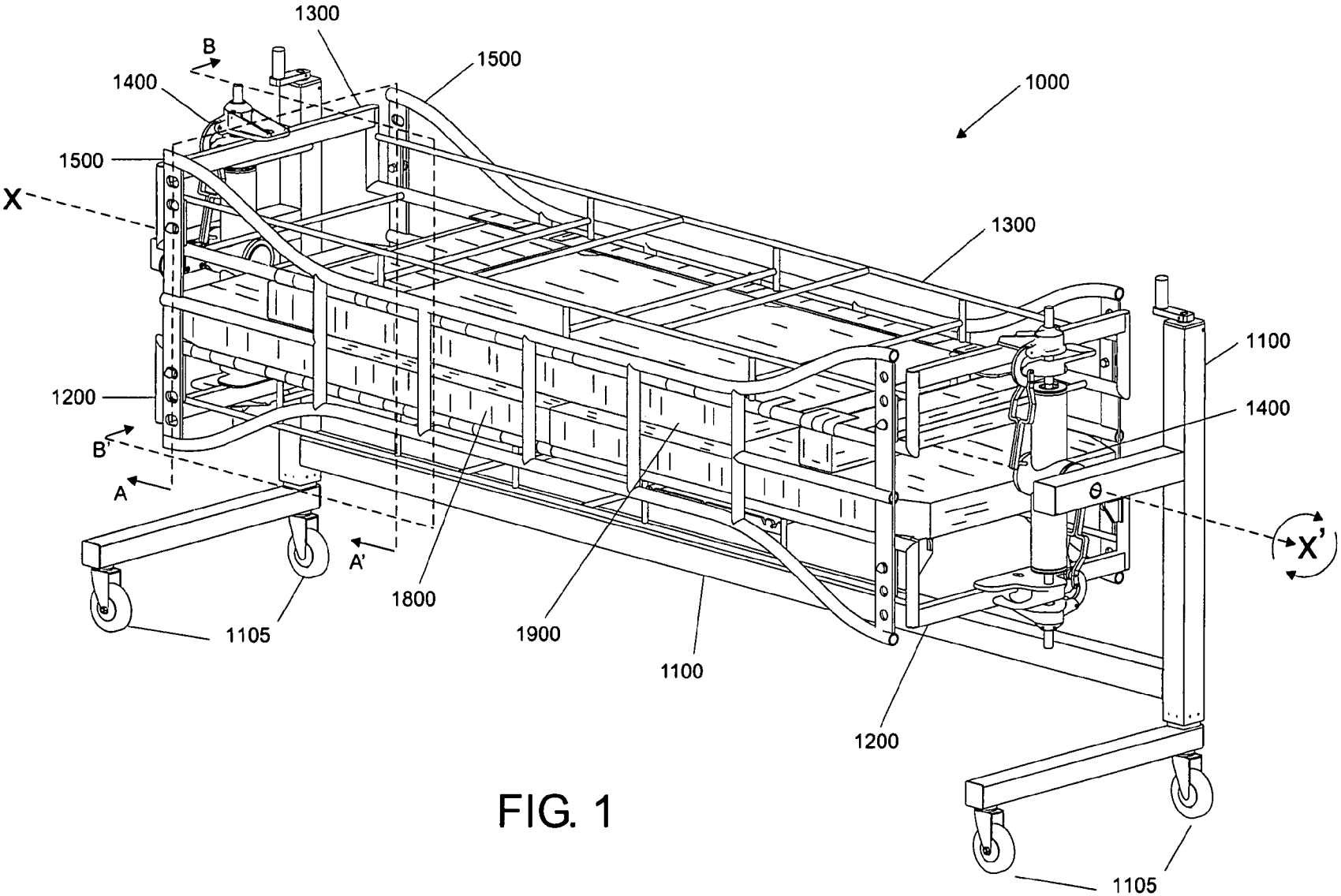
FIG. 1 is a top perspective view of a rotating therapeutic bed shown from its head board to its foot, which is constructed according to a particularly specific embodiment of the present invention.
Figure 2:
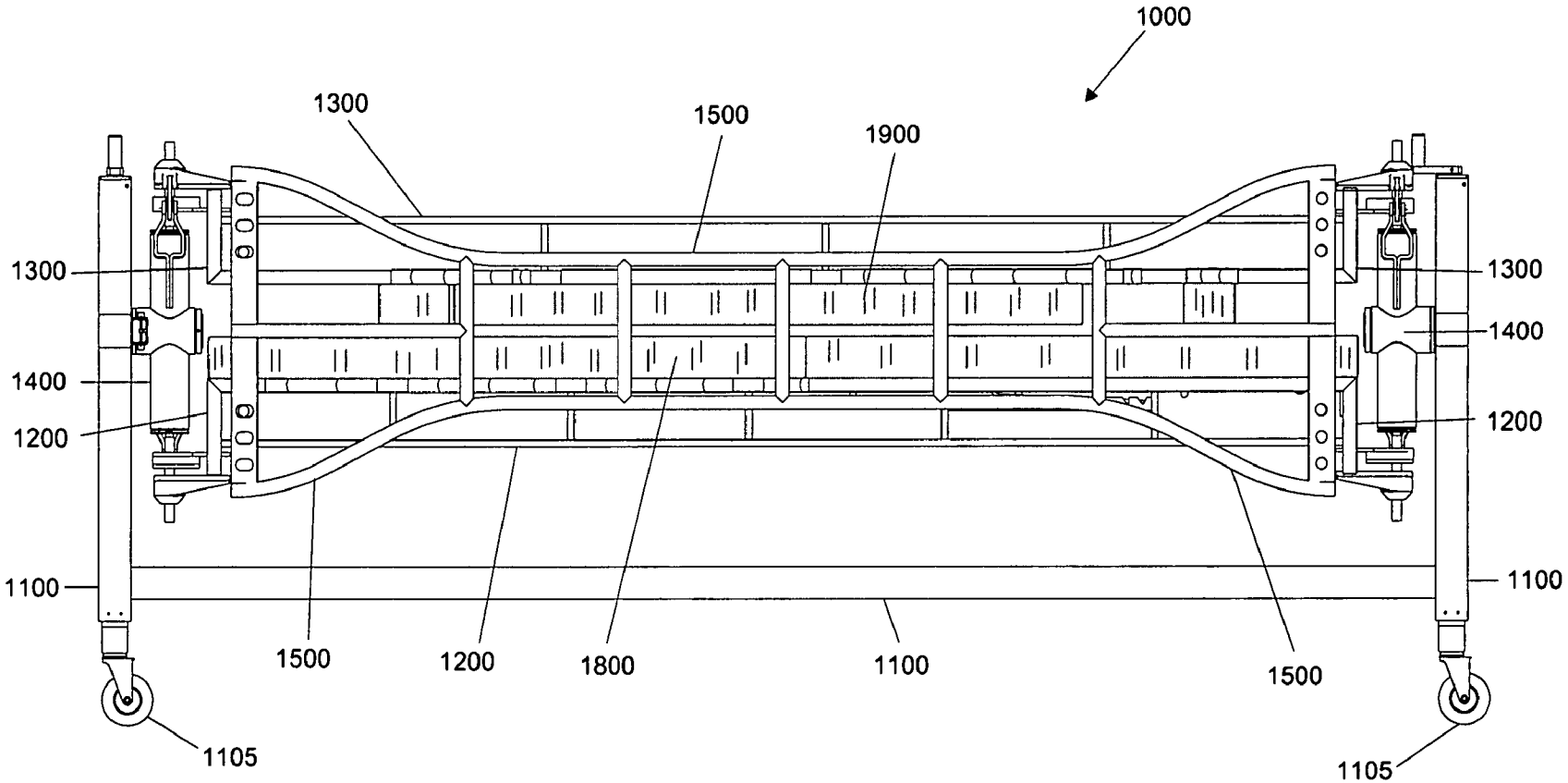
FIG. 2 is a side top view of the rotating therapeutic bed shown in FIG. 1.
Figure 3:
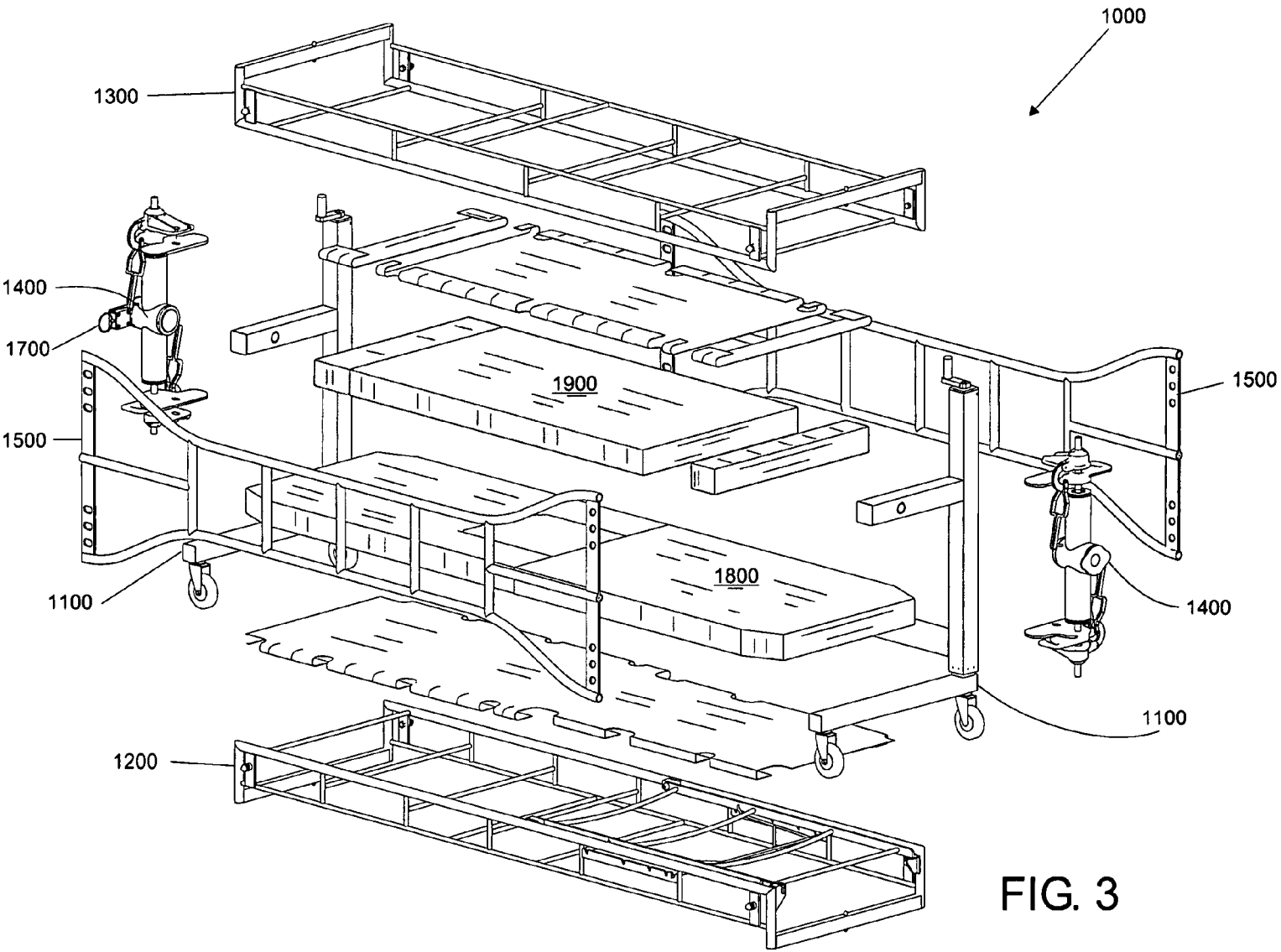
FIG. 3 is an exploded top perspective view of the rotating therapeutic bed shown in FIG. 1.

Referring to the appended drawings and more specifically to FIGS. 1-3, a rotating therapeutic bed 1000 is shown which is constructed according to a particularly specific embodiment of the present invention, which must be considered only as illustrative and non limitative in nature, such rotating therapeutic bed 1000 comprising in general and in combination: A structural base 1100 which includes turn wheels 1105 that are located on its lower part to allow relocating the bed from one place to another; a first removable stretcher 1200 having a first mattress 1800 to provide support for a patient (shown only in FIG. 11A of the appended drawings with referral number 2000) who is laying on his back; a second removable stretcher 1300 having a second mattress 1900 being located in an inverted fashion and over the first stretcher and patient, who is laying between the mattresses of both stretchers; the second stretcher 1300 providing support to the patient who is laying face down when stretchers are rotated by 180° on a rotation axis extending along the patient, such a rotation axis being indicated in FIG. 1 by a dashed line X-X'; members to mount and rotate the rear and front stretchers 1400, at the bed foot and head board, respectively, which are rotationally mounted in the structural base 1100; the first and second stretchers 1200 *y* 1300 being longitudinally mounted with a vertical spacing between them in such stretcher mounting and rotation members 1400 allowing them also to rotate; and side barriers 1500 coupled to the longitudinal sides of the first stretcher 1200, as well as of the second stretcher 1300, such barriers covering the vertical spacing between such stretchers where the patient is laying and preventing any of his limbs to protrude from the stretchers when being rotated.

As it may be seen from the above, the basic design of the rotating therapeutic bed 1000 of the present invention differs from that depicted in every bed of the documents mentioned in the chapter referring to the background of the invention, since the present invention does without the rings on which the 180° was performed. In the present invention, such a turn is achieved thanks to the stretcher mounting and rotation means 1400. Furthermore, the therapeutic bed of the present invention includes a second stretcher or platform 1300 which, by making the patient to rotate by 180°, firmly supports him laying face down, compared to the cushions of the previous art that were fastened only by strings.

Figure 4:
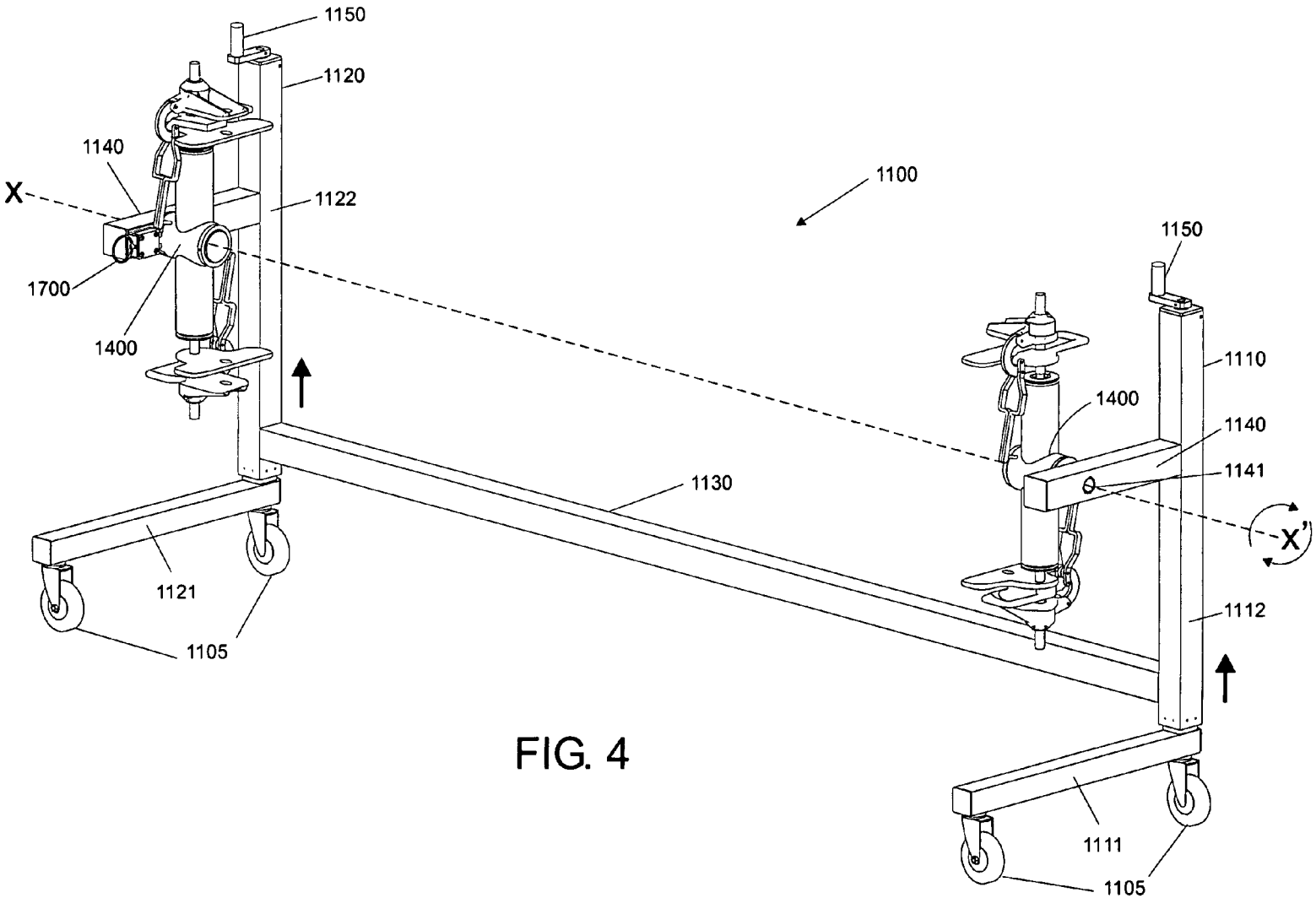
FIG. 4 is a top perspective view of the structural base forming part of the therapeutic bed of the present invention, which includes members for mounting and rotating stretchers, such a base being constructed according to the principles of the particularly specific embodiment of the present invention.

Furthermore, a very important aspect in the structure of the rotating therapeutic bed 1000 of the present invention is that related to the safety systems provided by it in order to avoid rotating the patient by 180° when the bed is partially disassembled and, for that purpose, the bed of the present invention further comprises: internal rotation-blocking means 1600 (see FIG. 10) provided in the inner part of every stretcher mounting and rotation member 1400 which, when being on their blocking position, internally prevent their rotationally movement and thus the stretchers and patient from being rotated when the bed 1000 is partially disassembled; and external rotation-blocking means 1700 that may be appreciated in FIG. 4, which are provided in the structural base 1100 and, when being on their blocking position, externally prevent their rotationally movement of at least one of the stretcher mounting and rotation members 1400, preventing thus both stretchers and the patient from being rotated.

The internal rotation-blocking means 1600 and external rotation-blocking means 1700 jointly operate, so that the rotation of the stretchers is achieved only when the first stretcher 1200 and the second stretcher 1300 are firmly mounted on the stretcher mounting and rotation members 1400, as well as when the side barriers 1500 are mounted on both stretchers, whereby the internal rotation-blocking means 1600 are automatically released to achieve then the 180° rotation of stretches 1200 and 1300 by manually releasing the external rotation-blocking means 1700.

In other words, the patient's rotation may be achieved only when the rotating therapeutic bed 1000 is fully assembled, which represents an advantage for the patient's safety. This is so because if only one of the stretchers, whether de first one 1200 or the second one 1300, were mounted and the patient were laying on it, whether laying on his back or face down, it would not be possible to rotate him by releasing the external rotation-blocking means 1700 because the internal rotation-blocking means 1600 would continue to be on their blocking position. In order to achieve such a 180° rotation, both side barriers 1500 must be mounted on stretchers 1200 and 1300.

As it has been mentioned before, in the particularly specific embodiment of the present invention, the external rotation-blocking means 1700 block the rotationally movement of at least one of the stretcher mounting and rotation members 1400, preferable the rear one (located at the bed's foot). However, it should be understood that they may also be provided in such a fashion that they prevent the front stretcher mounting and rotation member 1400 (at the bed's head board) from becoming blocked.

The particular operation of the internal rotation-blocking means 1600 and external rotation-blocking means 1700 in the specific embodiment of the present invention will be explained with more detail hereinafter.

Figure 5:
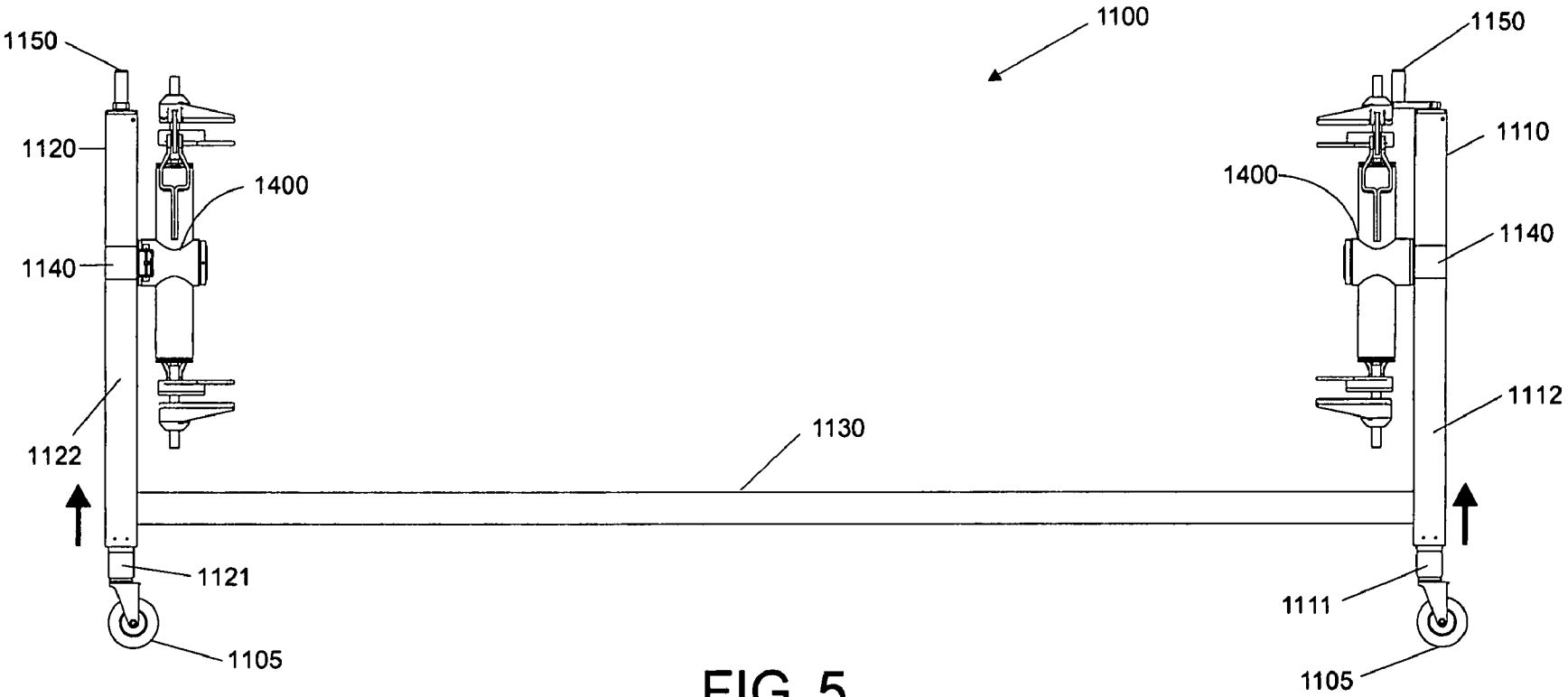
FIG. 5 is a side top view of the structural base shown in FIG. 4.
Figure 6B:
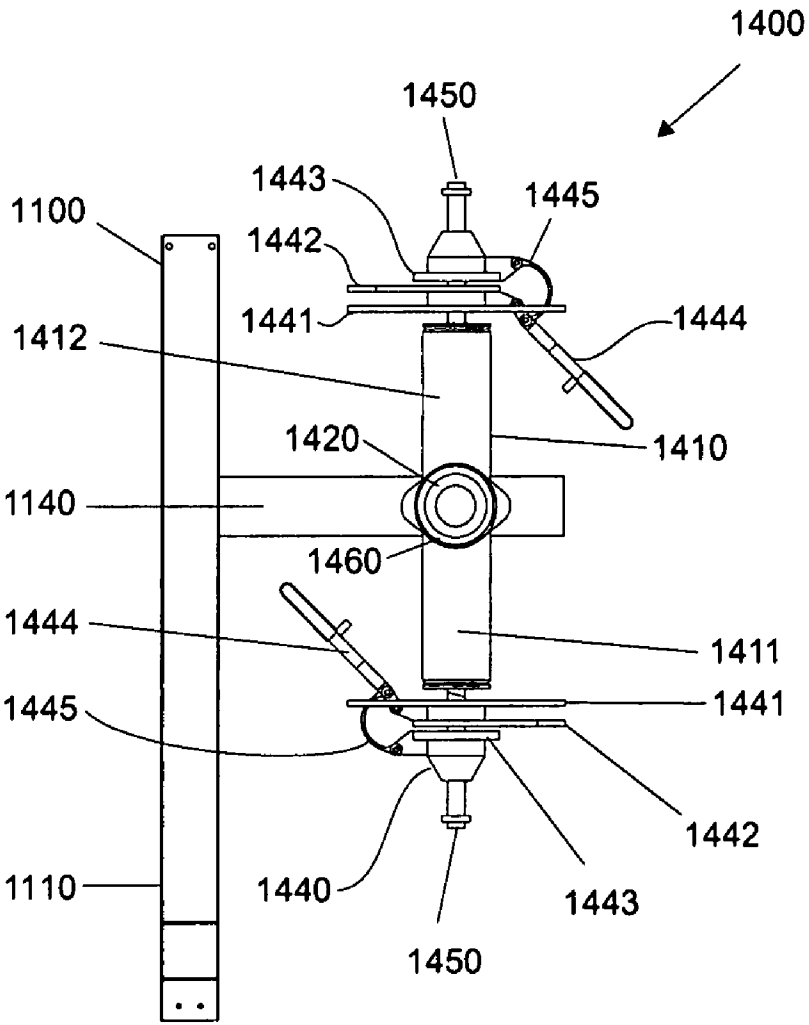
FIG. 6B is a front top view of the front stretcher mounting and rotation member, which is constructed according to the principles of the particularly specific embodiment of the present invention.
Figure 6A:
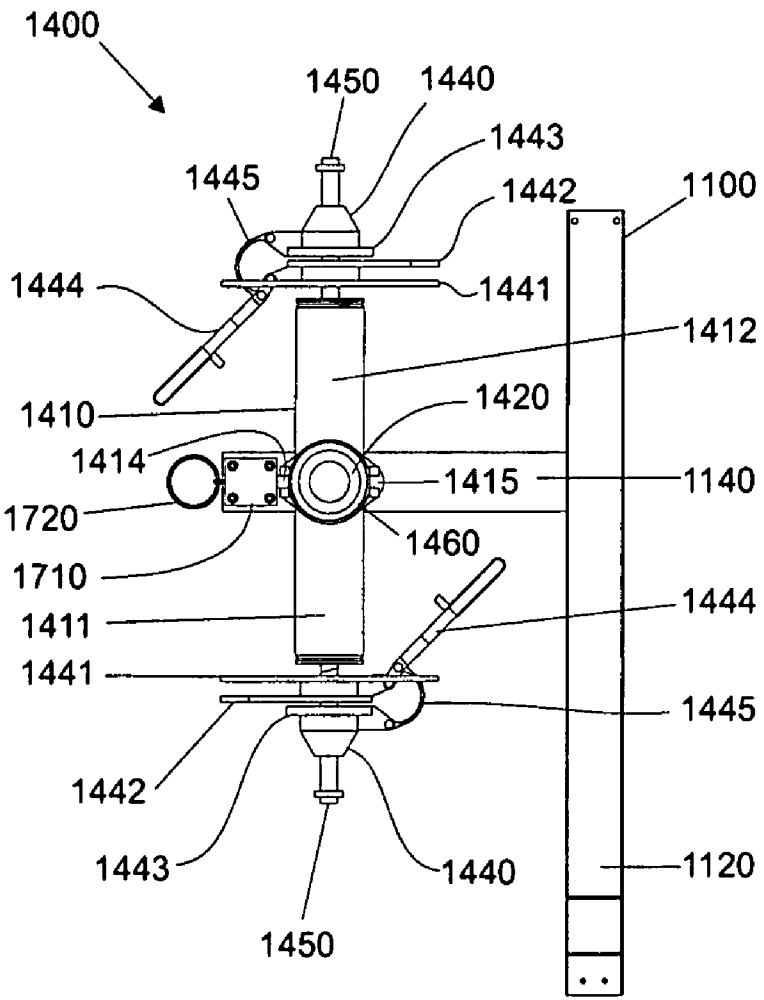
FIG. 6A is a front top view of the rear stretcher mounting and rotation member, which is constructed according to the principles of the particularly specific embodiment of the present invention.

On the other hand, particularly referring now to FIGS. 4 and 5 of the appended drawings, they show respectively a top perspective view and a top side view of the structural base 1100 where the rear and front stretcher mounting and rotation members 1400 are mounted; the structural base 1100 comprises: a front section 1110 and a rear section 1120, each one of them being formed by a horizontal portion 1111 and 1121 and a vertical portion 1112 and 1122 that is mounted on the corresponding horizontal portion forming an "L", an elongated intermediate section 1130 longitudinally located on the lower part of the base 1100 and attaching the front section 1110 to the rear section 1120; and rear and front support sections 1140 where such stretcher mounting and rotation members 1400 are mounted, the support sections 1140 being integrally provided at the upper half of the front section 1110 and of the rear section 1120, in addition to be perpendicularly provided with respect to the rotation axis X-X' on which the patient is rotated by 180°.

In the particular specific embodiment of the present invention, the front section 1110, rear section 1120, intermediate section 1130, and support section 1140 making up the structural base 1100 are made of straight tubular profiles (TPR) and, more preferably, by metal tubular profiles.

Another important issue of the structural base 1100 is that it includes a pair of conduits 1141, each one of them provided on each support section 1140 crossing its width from one end to another, such conduits being coaxially lined up with the patient rotation axis X-X' in order for traction means (not shown in figures) to be introduced towards the stretchers, which allow to perform the patient cervical traction therapy or in order for saline solution lines or other lines for taking medical care of the patient to be introduced.

Likewise, the structural base 1100 comprises inside it means to lift and tilt stretchers (no shown in figures) which are independently provided in the front section 1110, as well as in the rear section 1120 and which are manually actuated by a respective external crank 1150, such lifting means acting in such a manner on the inner front section 1110 and rear section 1120 that they allow to lift their vertical portions 1112 and 1122 over the respective horizontal portions 1111 and 1121, resulting in a lifting action on the height of stretchers 1200 and 1300. Further, when such means to lift and tilt stretchers act only on the front section 1110 or the rear section 1120, the stretcher plane where the patient is laying on is tilted, providing thus the Trendelenburg position that, as it was mentioned before, is important for this kind of patients.

As it can be seen, the structural base 1100 has a simplest and less bulky design compared to the bed bases of the previous art, since they include inside them means to lift and tilt stretchers which allow the patient to adopt the Trendelenburg position, being possible to be handled in narrow and small places. Likewise, its design includes conduits 1141 through which means for performing the cervical traction operation to the patient are introduced.

Particularly referring now to FIGS. 6A to 8B, wherein joint views of the members to mount and to rotate the rear and front stretchers 1400 are shown, in which every one of them comprises: a rotationally hollow housing 1410 that is divided in a hollow intermediate section 1413 having preferably a cylindrical shape coaxially lined up to the patient rotation axis X-X'; a first radial section 1411; and a second radial section 1412, both being hollow, having preferably a cylindrical shape, and being perpendicularly placed on the intermediate section 1413 and attached to it; the radial sections 1411 and 1412 are further located on the housing in an extremely opposed relation one to another; a fixed rotation support axis 1420 provided in the inner part of the intermediate section 1413 and which is securely attached on one of its ends to the structural base 1100, such rotation support axis 1420 being preferably formed by a steel tube section and coaxially lined up with conduits 1141 of structural base 1100; a bearing 1430 (that may be appreciated in FIGS. 22A to 22C) placed between the rotation support axis 1420 and the inner wall of the intermediate section 1413, allowing a soft and homogenous rotation of the housing 1410 on the fixed rotation support axis 1420 and thus on the rotationally movement of the stretchers and the patient; the bearing is preferably a rotation bearing or bushing that is preferably made of bronze; and stretcher securing means or jaws 1440 (FIGS. 6A to 8B) that are provided on the distal portion of every radial section 1411 and 1412; every member to secure stretchers or jaw 1440 is mounted on a mounting axis 1450 that is coaxially located at the inner portion of every radial section 1411 and 1412 of housing 1410, the first and second stretchers 1200 and 1300 being mounted on such stretcher securing members 1440.

Figure 9:
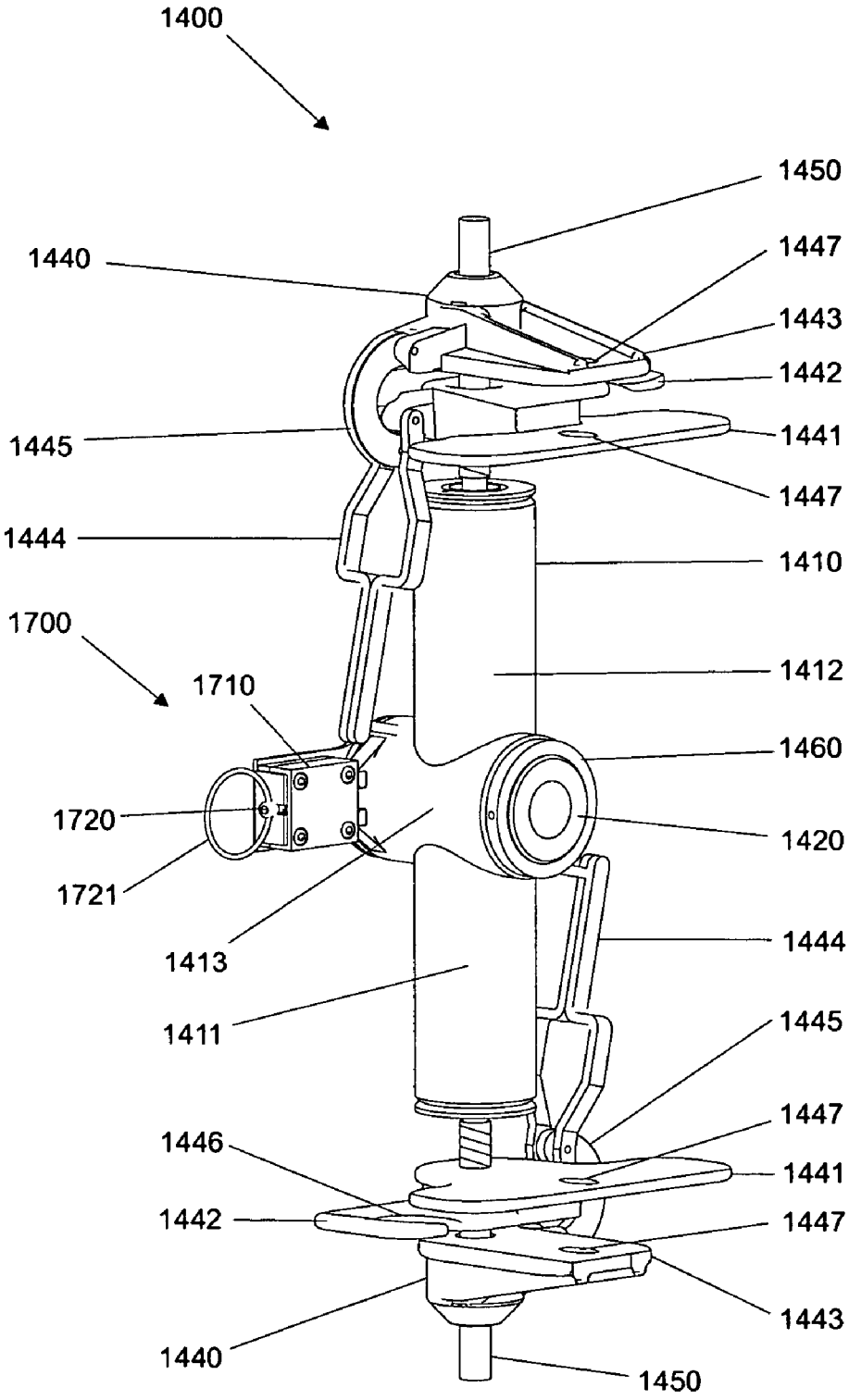
FIG. 9 is a top perspective view of the rear stretcher mounting and rotation member shown in FIG. 6A.
Figure 10:
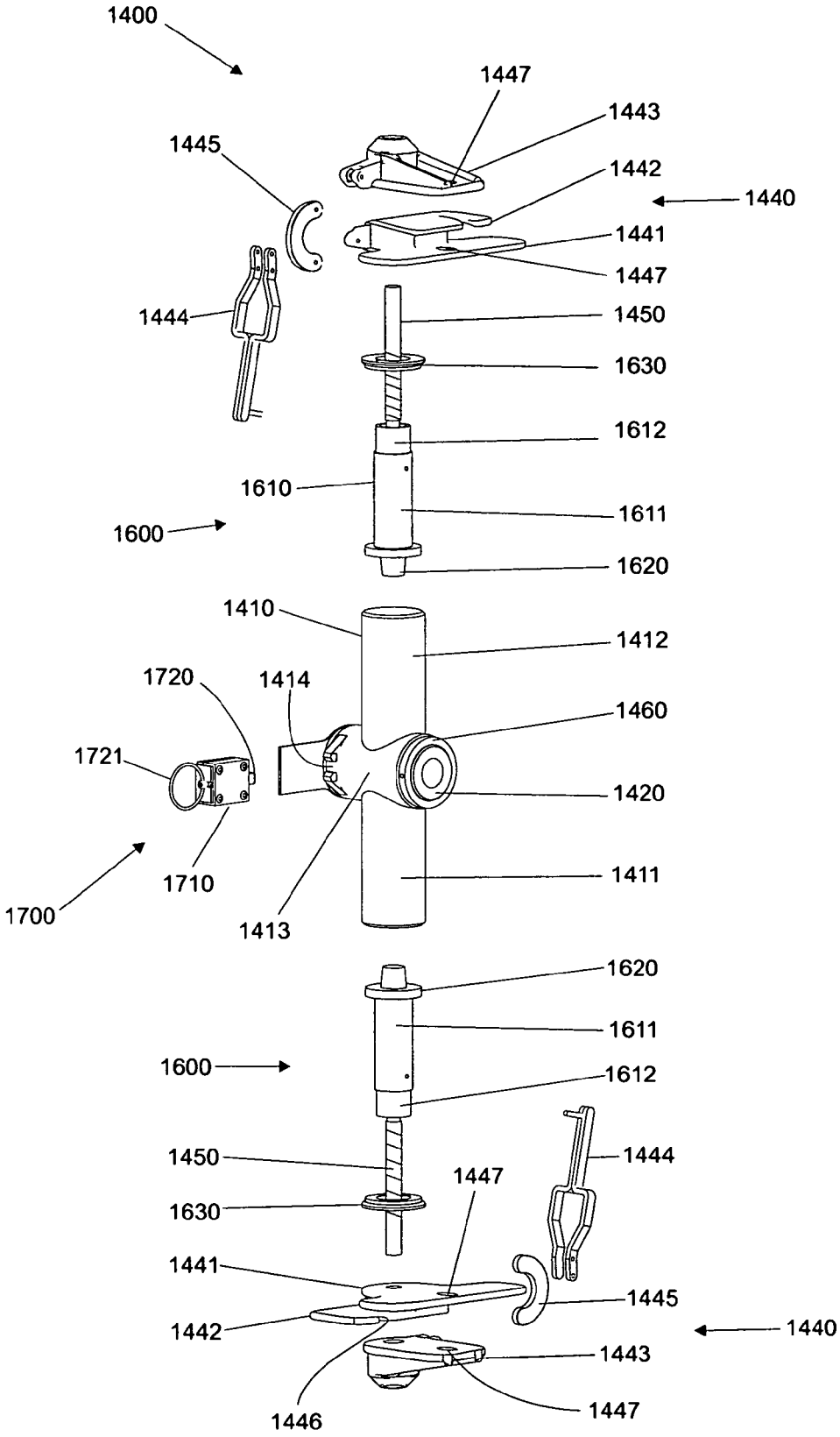
FIG. 10 is an exploded top perspective view of the rear stretcher mounting and rotation member shown in FIG. 9.

In order to depict the way in which such stretcher securing members 1440 are provided on the radial sections, reference is now made to FIGS. 9 and 10, which show the stretcher mounting and rotation member 1400 provided in the rear portion of the bed 1000 of the present invention. However, it should be understood that the stretcher securing members 1440 are provided in the same manner on the front stretcher mounting and rotation member 1400.

In particular, the mounting axis 1450 of every member to secure stretchers 1440 is threaded at its proximal portion with respect to the patient rotation axis and it is flat on its distal portion (see FIG. 10), and every member to secure stretchers 1440 comprises: a proximal plate 1441 attached to the threaded portion of the mounting axis 1450 and that may be moved on it in order to adjust the height at which stretchers are mounted with respect to the patient rotation axis; a distal plate 1443 apart from the proximal plate and that slides freely on the flat surface of the mounting axis 1450, the distal plate being attached to the proximal plate 1441 by means of a connection element 1445; and a closing plate 1444 operatively attached to the connection element 1445 that at its closing position reduces the spacing distance between the proximal plate 1441 and the distal plate 1443 in order to secure the first stretcher 1200 or the second stretcher 1300, with such a distance reduction between the plates making the stretchers 1200 and 1300 to be securely mounted.

On the other hand, in order to prevent undesired horizontal movements of the housing 1410 on the fixed rotation support axis 1420, every member to mount and to rotate the front and rear stretchers 1400 includes a stop element 1460 placed on the free end of the fixed rotation support axis 1420. Such stop element may be removed in order to disassemble the stretcher mounting and rotation members 1400 from the structural base 1100.

Referring now more specifically to FIG. 10, it shows also internal rotation-blocking means 1600 which should be understood to be included also in the member to mount and to rotate front stretchers 1400.

Specifically, the internal rotation-blocking means 1600 are provided in pairs within each rear or front stretcher mounting and rotation member 1400; every one of such pairs is housed in every radial section 1411 and 1412 of the housing 1410 and comprises: a main body 1610 which travels in the inner portion of the corresponding radial section of the housing 1410 of the stretcher mounting and rotation member 1400, such a main body 1610 being preferably in a cylindrical shape and being divided in two sections: a proximal portion 1611 and a distal portion 1612 having a diameter less than that of the proximal portion 1611; such main body 1610 being attached to the mounting axis 1450 of the stretcher securing members 1440; a blocking safety device 1620 that is attached to the proximal end of the main body 1610; and a stop 1630 that is secured to the corresponding radial section end 1411 or 1412 of the housing 1410 of the stretcher mounting and rotation member 1400; the blocking safety device 1620 blocking the rotation of housing 1410 when it is within a cooperating cavity 1421 (that may be appreciated in FIGS. 22B and 22C) that is provided in the fixed rotation support axis 1420 for every one of such a pair of internal rotation-blocking means 1600, the blocking safety device 1620 being released when the main body 1610 is moved within the corresponding radial section of the housing 1410 by a distance enough for the distal portion 1612 of the main body 1610 to protrude from such a radial section; the shift movement being stopped by the stop 1630 which prevents the proximal portion 1611 of the main body 1610 from protruding also from the housing. The above may be more readily seen in FIGS. 22B and 22C.

On the other hand, referring again to FIGS. 9 and 10, they show the external rotation-blocking means 1700 that are provided on the structural base 1100 and preferably act on the rear stretcher mounting and rotation means 1400. However, as it was mentioned before, they may be provided in order to act on the front stretcher mounting and rotation member 1400. More particularly, the external rotation-blocking means comprise: a housing 1710 attached to the support section 1140 of the structural base 1100; and a retractile bolt 1720 crossing the housing 1710 from one end to the other; at the blocking position, the first end of such a bolt 1720 is housed within a first cavity 1414 that is provided on the middle part of the stretcher mounting and rotation member 1400, whereby its rotationally movement is externally blocked; at the second end of the bolt, a ring 1721 is provided in order to manually move the bolt to remove its first end from the first cavity 1414, whereby the bed is free for a 180° rotation.

Since the bolt 1720 is retractile, when the 180° rotation has come to an end, its first end is automatically housed in a second cavity 1415 provided on the stretcher mounting and rotation member 1400 in an extremely opposed relation to the first cavity 1414, whereby the rotationally movement is automatically blocked again. Such a second cavity may be particularly appreciated in FIG. 6A.

Figure 11:
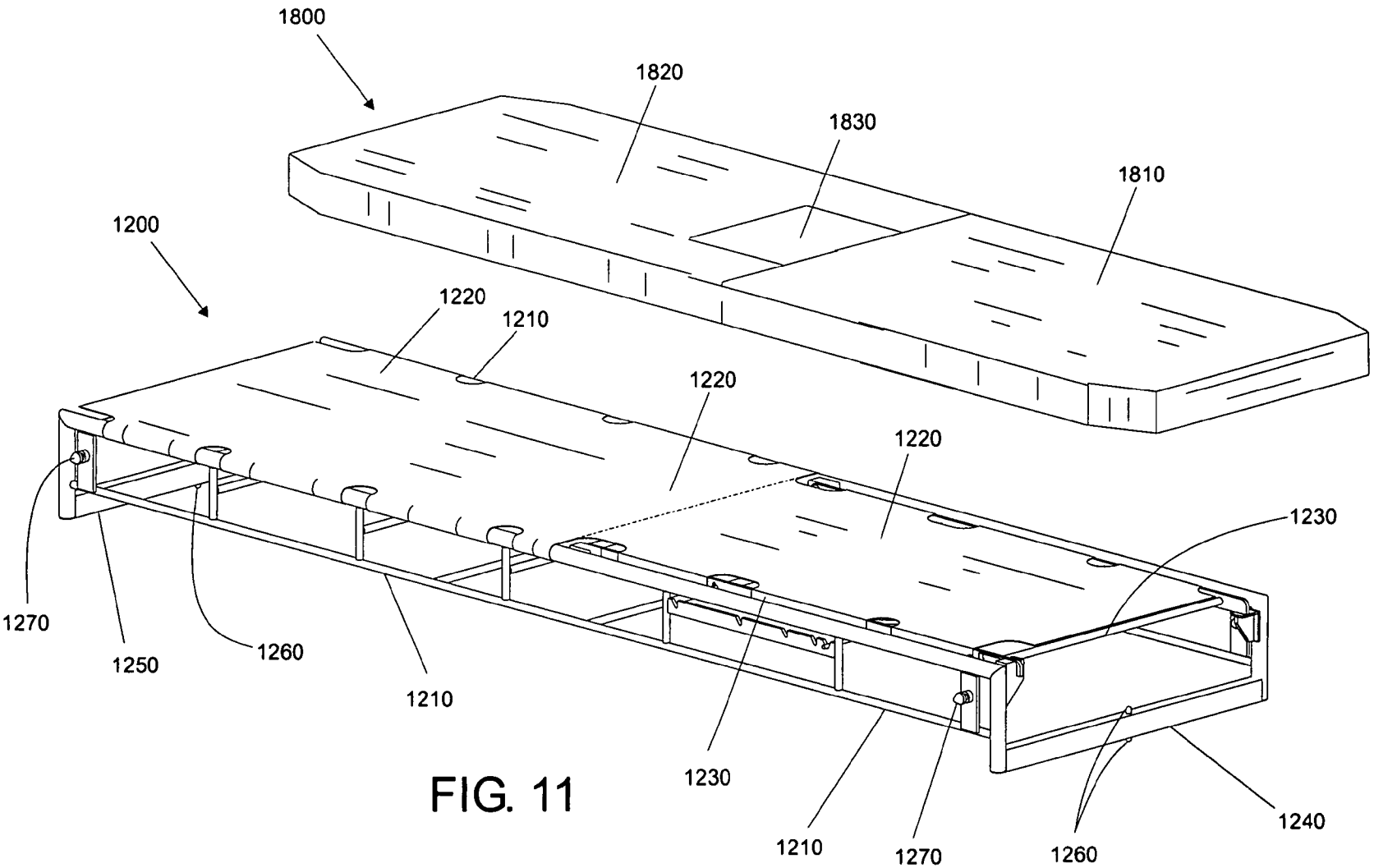
FIG. 11 is a top perspective view of the first stretcher that is part of the rotating therapeutic bed, which is constructed according to the principles of the specific embodiment of the present invention.
Figure 12:
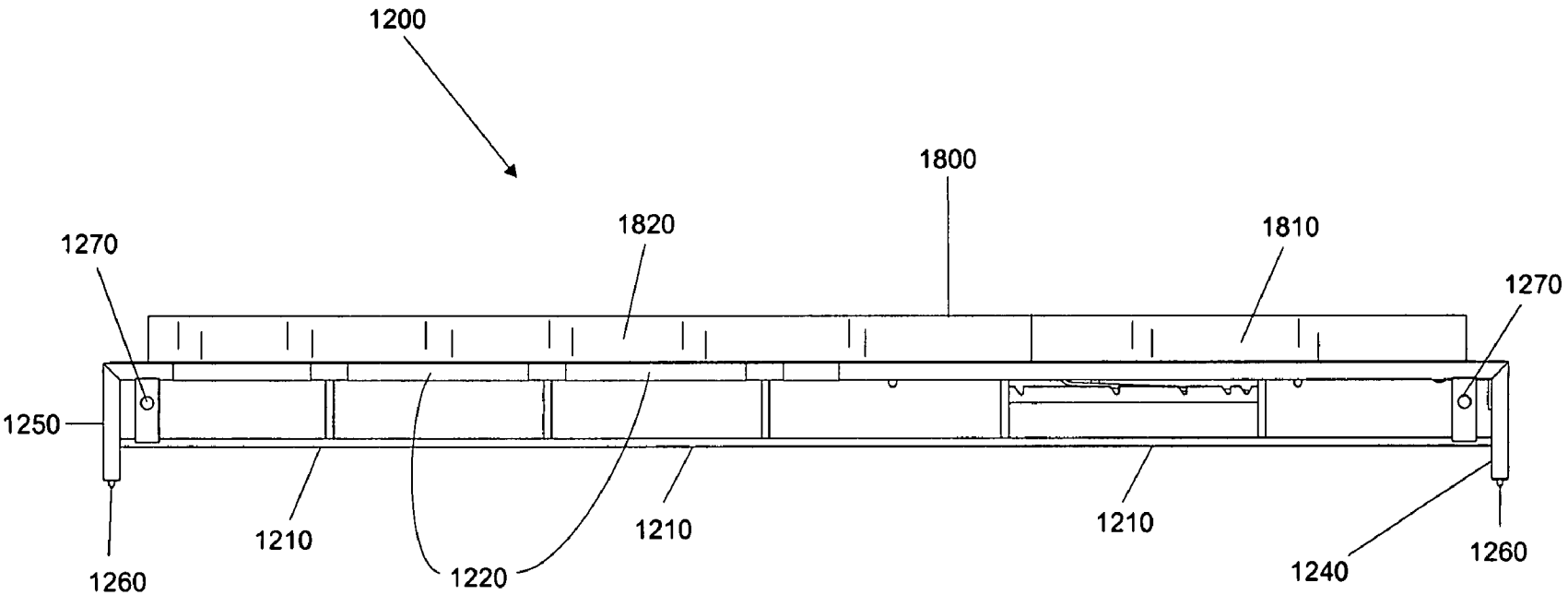
FIG. 12 is a top side view of the first stretcher shown in FIG. 11.
Figure 13:
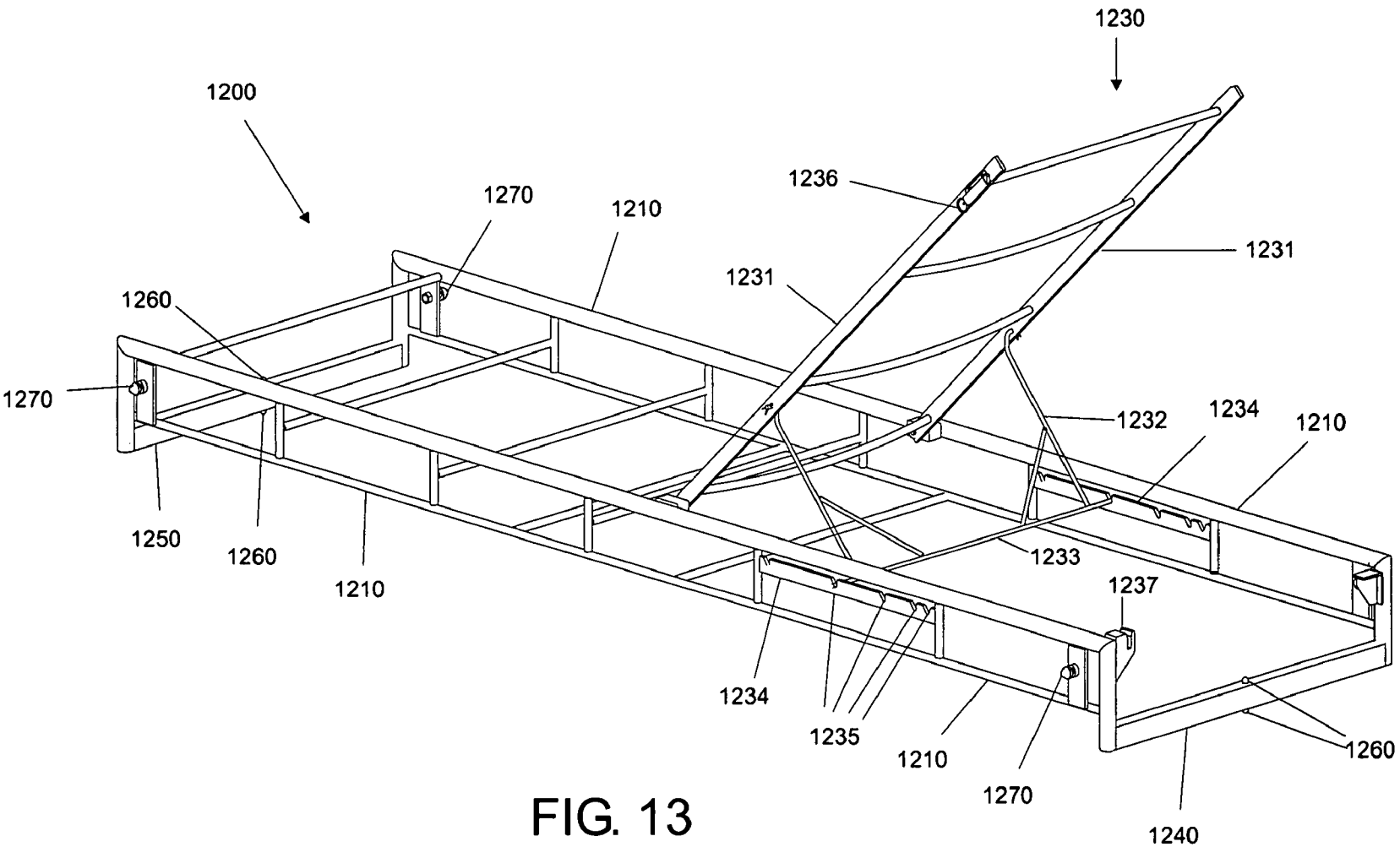
FIG. 13 is a top perspective view of the frame of the first stretcher showing a back support in a lifted position allowing to keeping the patient seated.

On the other hand, referring to FIGS. 11, 12, and 13, which show several views of the first stretcher 1200 supporting the patient on his back that, in addition to the first mattress 1800, comprises: a main frame 1210 in a rectangular shape including at its front and rear ends sections to mount stretchers 1240 and 1250, allowing the stretcher to be mounted on the stretcher mounting and rotation members 1400; a cover or coating 1220 covering the upper surface of the main frame 1210 in order to place the first mattress 1800; and a folding section or support 1230 provided as a hinge on the front portion of the stretcher in order to keep the patient seated on it.

Regarding the first mattress 1800, it is divided in: a front mattress folding section 1810 as a hinge and coincident with the folding section 1230; a rear mattress section 1820 provided with a removable section 1830 which, once the first mattress 1800 is removed, allows to place a bedpan (not shown in figures) in order for the patient to be able to evacuate.

Figure 11B:
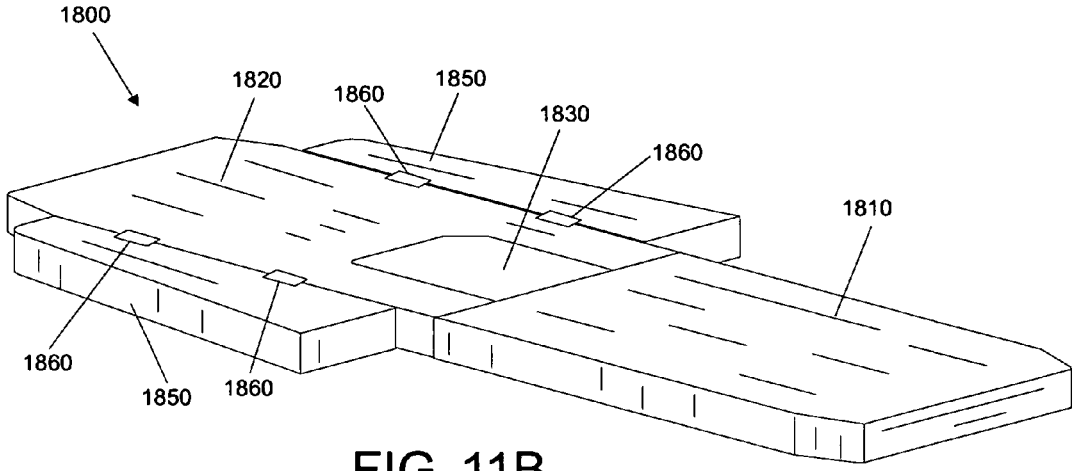
FIG. 11B is a top perspective view of the mattress illustrated in FIG. 11A in an extended position and seen from its front end to its rear end.
Figure 11A:
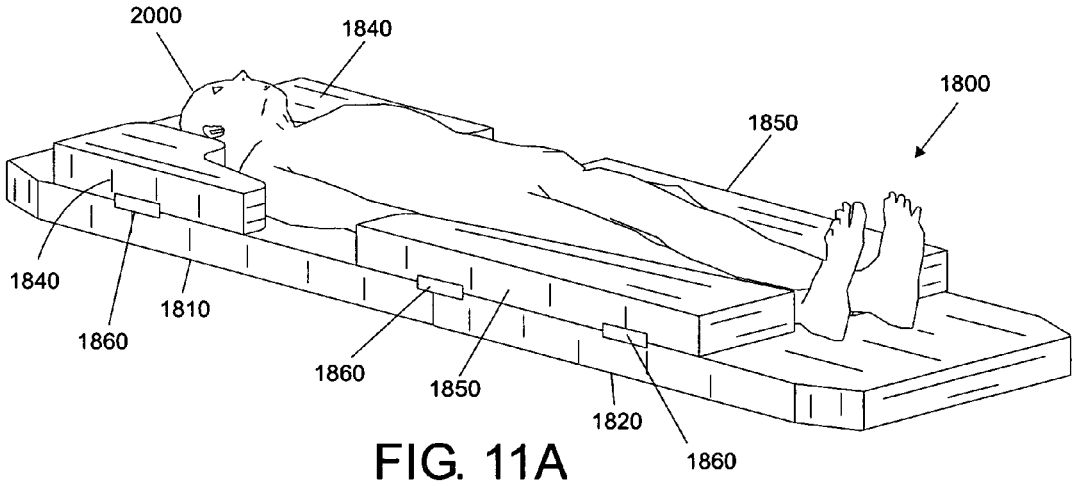
FIG. 11A is a top perspective view of a mattress which is constructed according to an alternative embodiment of the present invention, which shows a patient laying and resting in such a mattress.

In an alternative embodiment of the bed of the present invention, the first mattress further includes on its surface front and rear padded stop sections 1840 and 1850, respectively, detachably jointed or attached as a hinge to the sides of the mattress 1800 through attachment and closing means 1860, which are preferably hook strips and short fibers (Velcroâ). By being located on the first mattress 1800, such stop sections form a space between them similar to the body of the patient 2000 preventing that, when rotating the stretchers, the patient is laterally moved. Likewise, the front and rear stop sections 1840 and 1850 work as a side extension surface (see FIG. 11B) of the mattress when they are moved on such attachment and closing means, the extension surface formed on the mattress being useful to place on it light articles or the patient's arms or legs.

In the specific embodiment of the present invention, the first mattress 1800 is covered with a watertight material, such as canvas or plastic, which facilitates the cleaning of the patient and of the mattress itself.

With respect to the folding section or back support 1230, it can be more readily seen in FIG. 13 and is made up by a secondary frame 1231, preferably in a rectangular shape, which is attached as a hinge to the main frame 1210 of the first stretcher; a support frame 1232 attached as a hinge to the lower portion of the secondary frame 1231 and allowing to keep the back support 1230 at the desired position when such a frame is supported on the main frame of the first stretcher by means of a horizontal support base 1233; and position selection bars 1234 that are attached to the longitudinal sides of the main frame 1210 of the first stretcher 1200, and such bars are provided with a plurality of position notches 1235 receiving the ends of the support base 1233 and achieving thus the desired inclination of the back support 1230.

In the specific embodiment of the present invention, the back support 1230 is further provided with back support securing means which allow make secure it to the main frame 1210 of the stretcher in a horizontal position. In particular, such securing means are a pin 1236 that is introduced in a recess or cooperating notch 1237 provided in one of the front inner corners of the main frame 1210 of the first stretcher.

On the other hand, as it may be seen in FIGS. 11 to 13, the stretcher mounting sections 1240 and 1250 are provided in the main frame of the first stretcher as a horizontal transversal bar.

With respect to the manufacturing materials of the elements integrating the first stretcher 1200, it may be said that the main frame 1210 and the folding section 1230 are made of light metal materials, preferably aluminum or steel, using more preferably aluminum due to its low specific weight, whereby the stretcher is light and strong enough. Furthermore, such a material may be in contact with water without being oxidized or corroded.

Likewise, the coating 1220 is made of watertight materials, such as canvas or plastic, which allow to properly clean the patient on bed.

Figure 14:
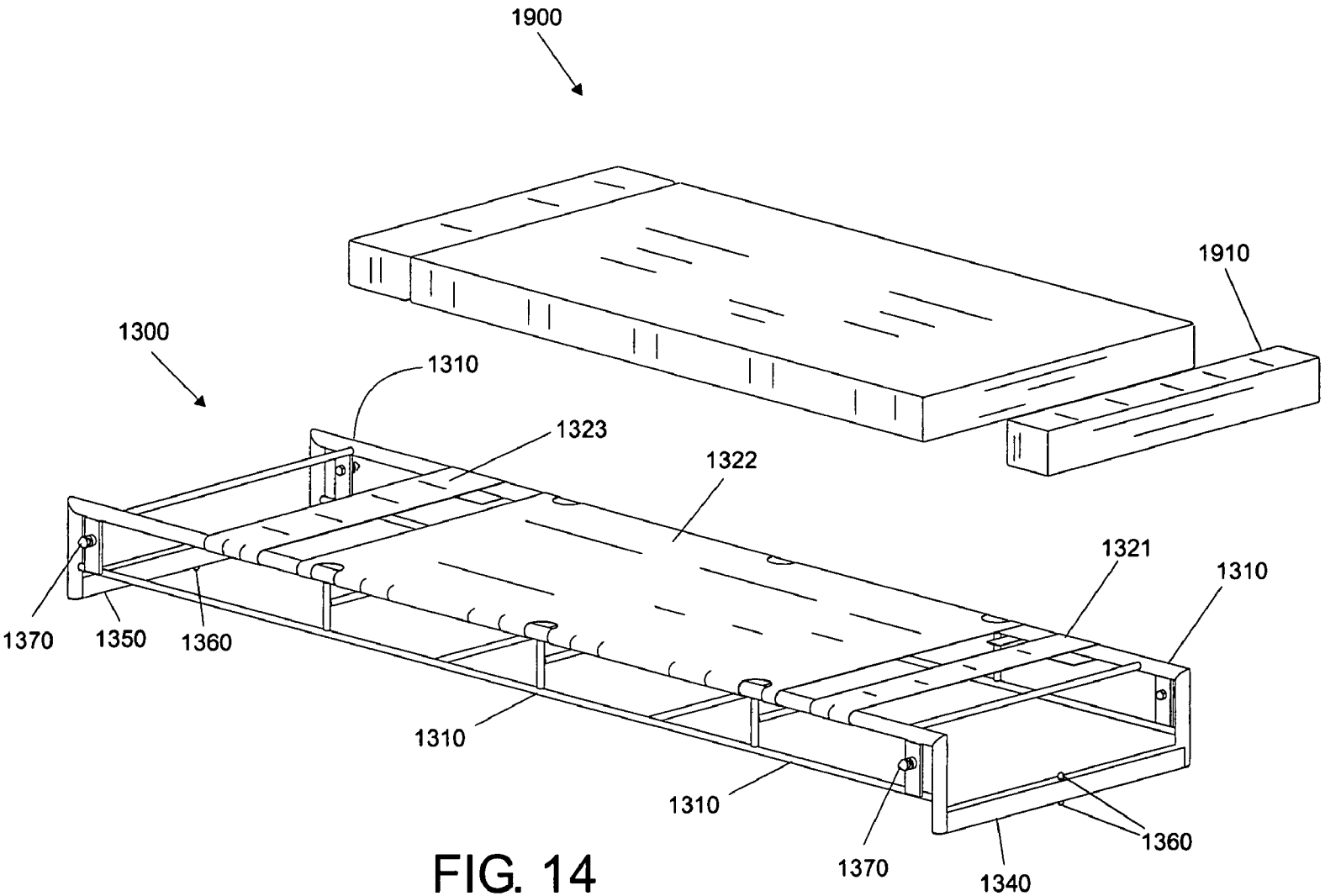
FIG. 14 is a top perspective view of the second stretcher that is part of the rotating therapeutic bed, which is constructed according to the principles of the particularly specific embodiment of the present invention.
Figure 15:
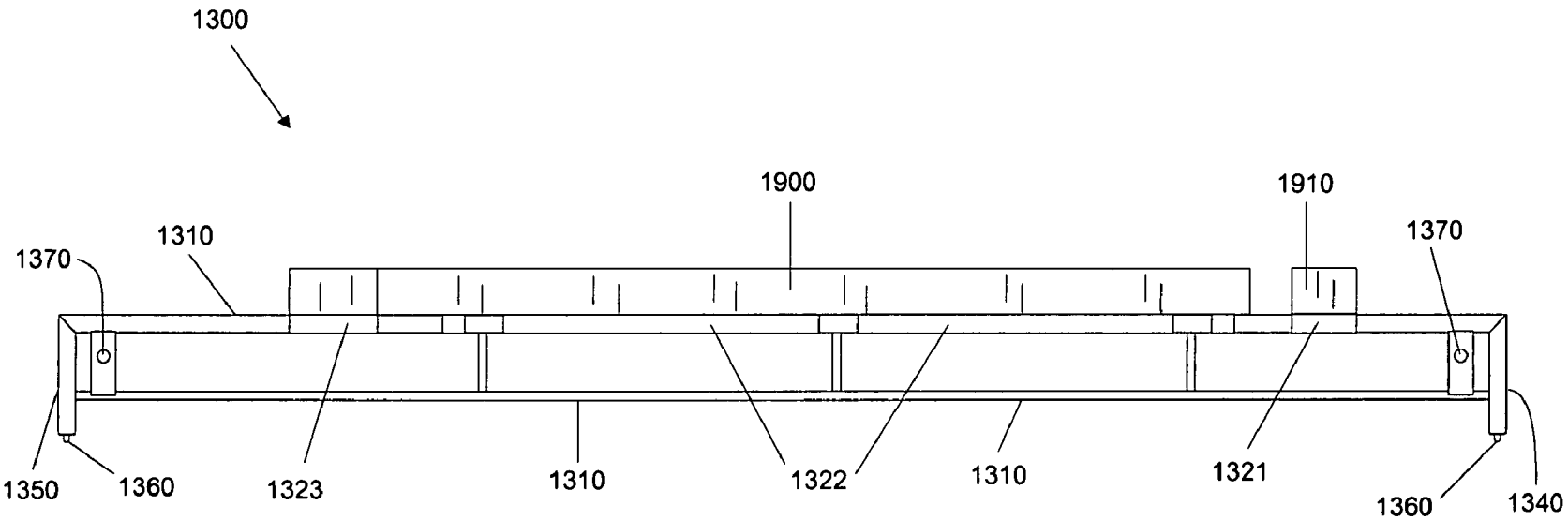
FIG. 15 is a side perspective view of the second stretcher shown in FIG. 14.

Referring now to FIGS. 14 and 15, which show several views of the second stretcher 1300, which is rotated by a 180° angle compared to how it is shown in FIGS. 1 to 3 of the appended drawings, in addition to the second mattress, the first stretcher comprises: a main frame 1310 of rectangular shape including at its front and rear ends stretcher mounting sections 1340 and 1350 allowing the stretcher to be mounted on the stretcher mounting and rotation members 1400; front, intermediate, and rear coating portions 1321, 1322, and 1323, respectively, which are spaced from one another covering most part of the upper surface of the main frame 1310, the second mattress 1900 being placed on the intermediate coating portion 1322 and rear coating portion 1323 to support most part of the patient's body when he is laying face down; and a pillow or cushion 1910 which is placed on the front coating portion 1321 to support the patient's forehead when he is laying face down.

Regarding the above, such a pillow 1910 and the front coating section 1321 are respectively apart from the second mattress 1390 and from the intermediate coating section 1322 at a distance enough to allow the patient having his visual field free and without interferences when being laying face down.

Likewise, the material of the main frame 1310 of the second stretcher 1300 is made of metal materials, such as aluminum or steel, preferably aluminum due to its low specific weight, as well as the coating portions are made of watertight materials, such as canvas or plastic. Regarding the second mattress 1900 and the pillow 1910, they are coated with the abovementioned watertight materials.

On the other hand, the stretcher mounting sections 1340 and 1350 are provided on the main frame of the second stretcher in the shape of a horizontal transversal bar, such as in the first stretcher.

Figure 16:
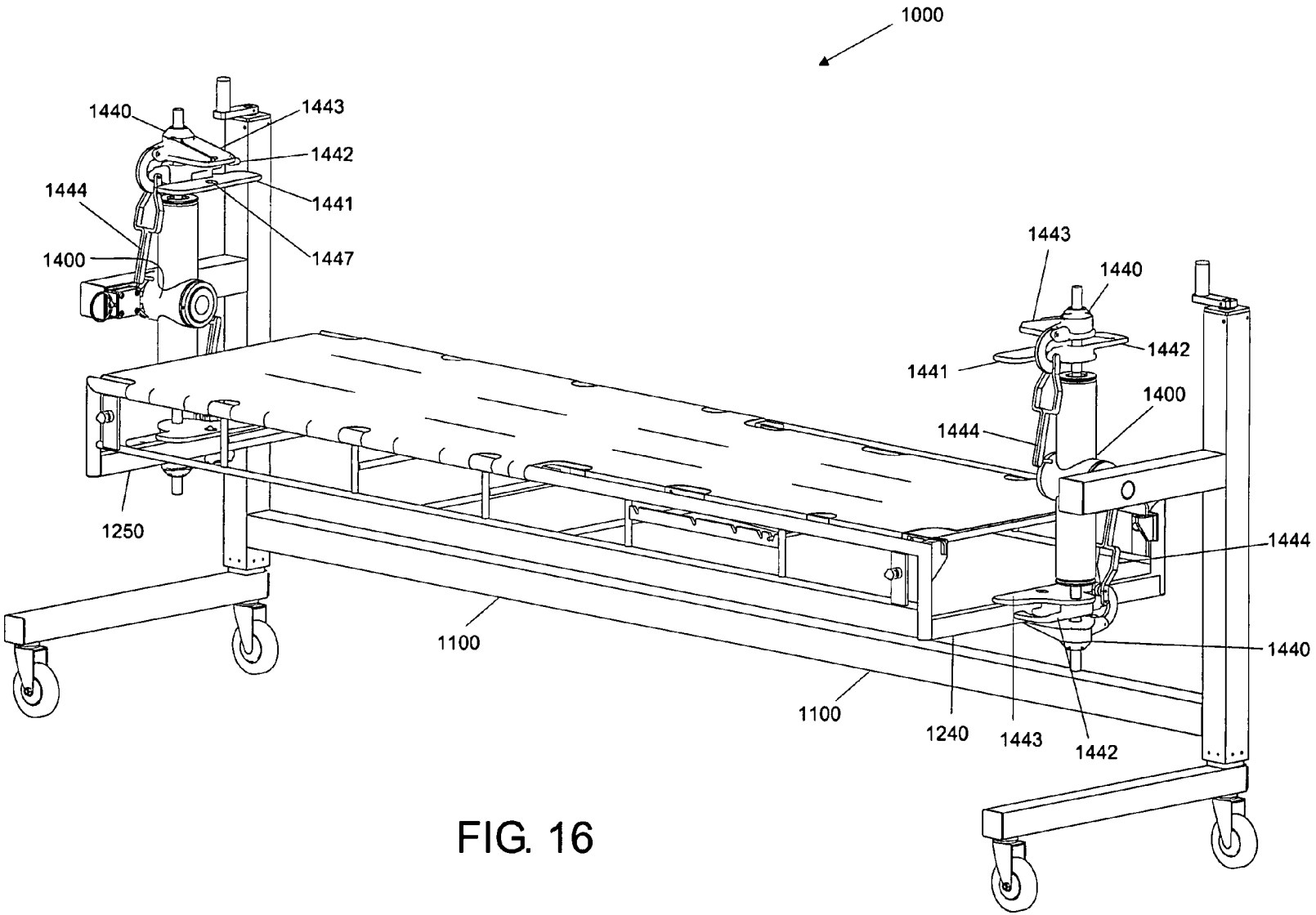
FIG. 16 is a top perspective view of the assembly of the first stretcher and the front and rear stretcher mounting and rotation members.
Figure 17:
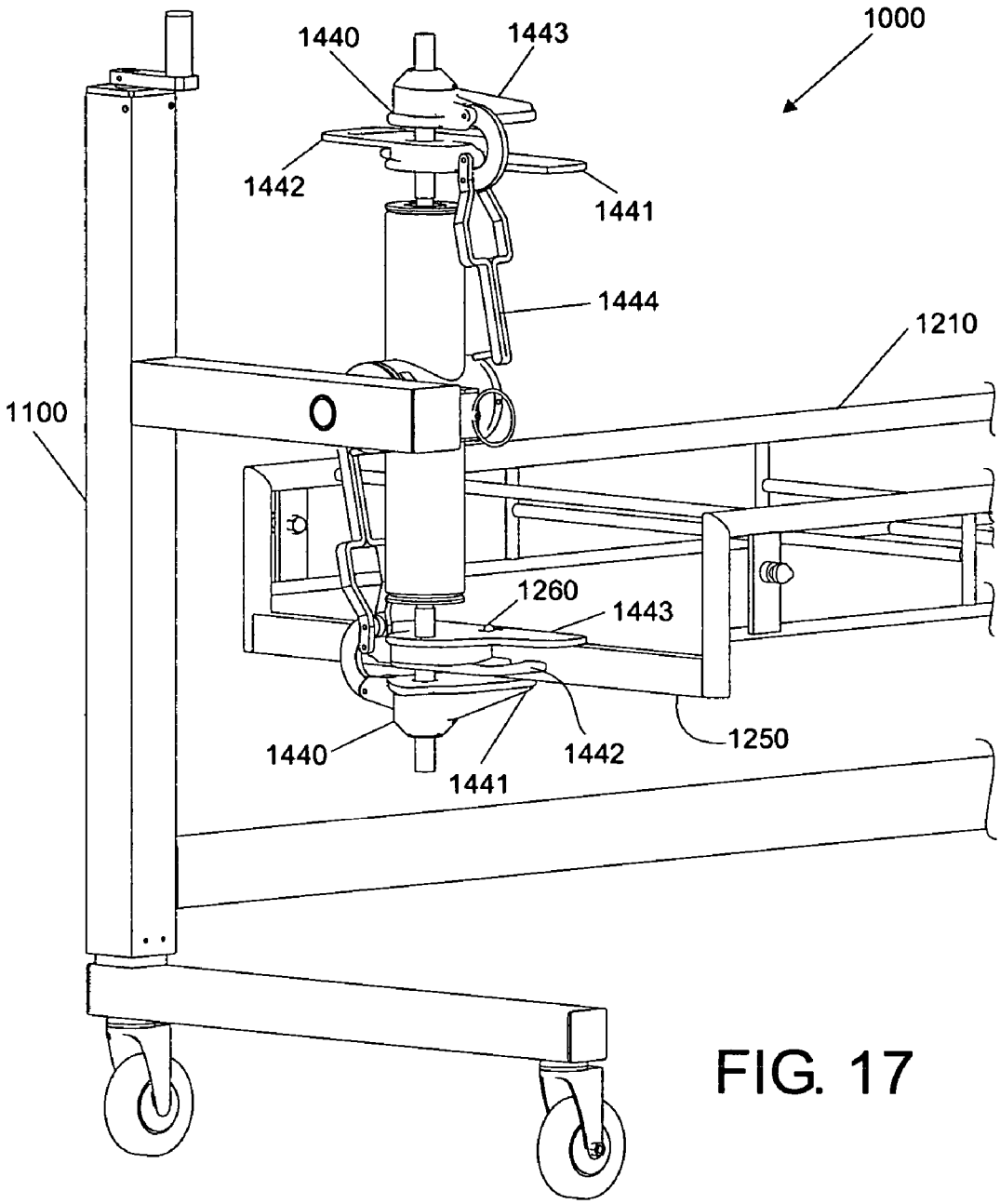
FIG. 17 is a bottom perspective view of the rear and inner part of the bed, which shows the assembly of the first stretcher and the rear stretcher mounting and rotation member.
Figure 18:
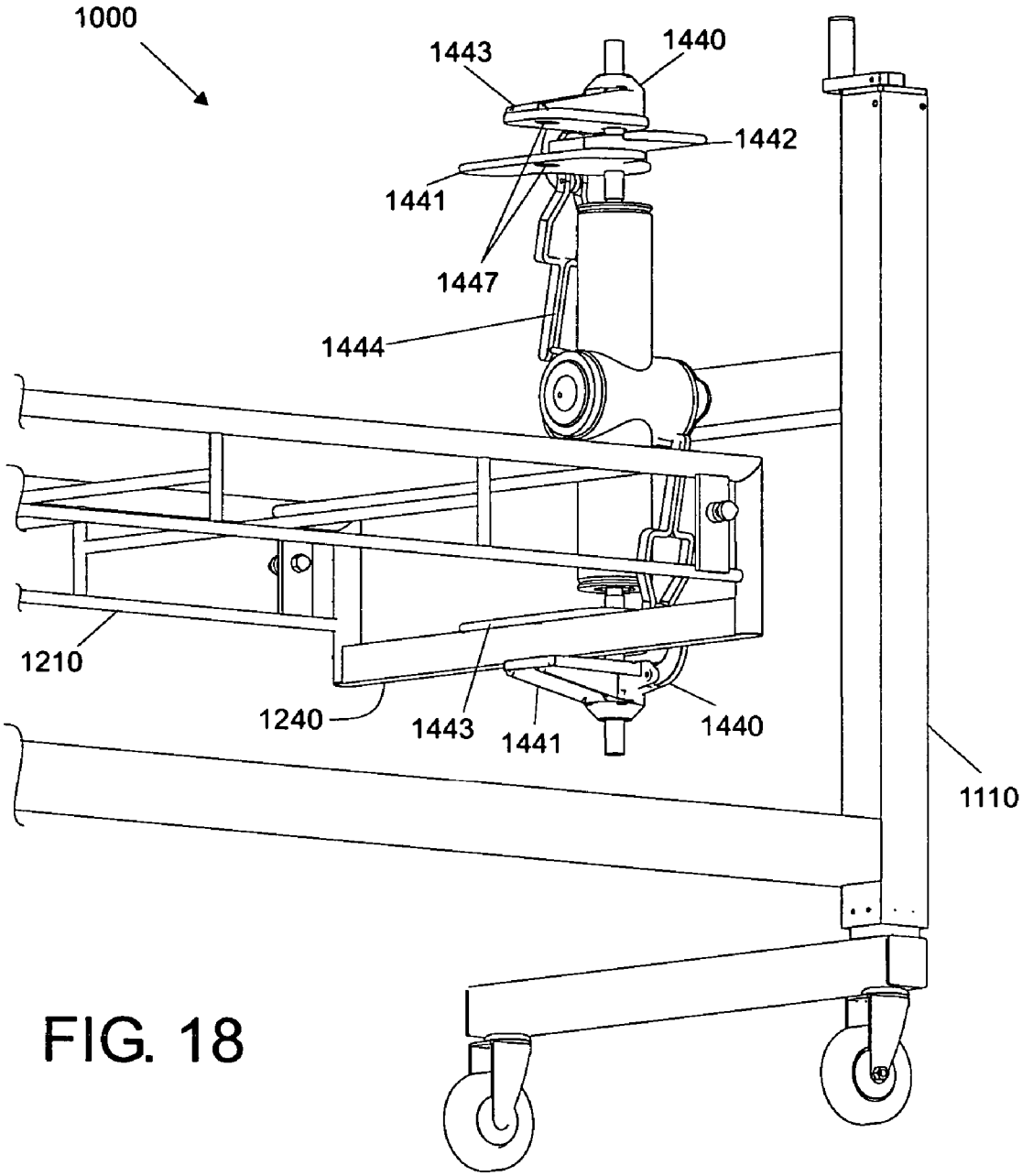
FIG. 18 is a bottom perspective view from the inner part of the bed towards its front part, which shows the assembly of the first stretcher and the front stretcher mounting and rotation member.

Regarding how the first and second stretchers 1200 and 1300 are mounted on the rear and front stretcher mounting and rotation members 1400, referring now to FIGS. 16 to 18, wherein the first stretcher 1200 longitudinally mounted between the rear and front stretcher mounting and rotation members 1400, it should be understood that the mounting of the second stretcher 1300 is similar to that one. However, it should be remembered that the second stretcher is placed in a reversed fashion and over the patient.

More particularly, it may be seen in FIG. 16 that every stretcher mounting section 1240 or 1250 of the first stretcher 1200 is pressed between the proximal plate 1441 and the distal plate 1443 of a stretcher securing member 1440 so that, when the lever of such a stretcher securing member is closed, the stretcher 1200 is firmly secured. It is very important mentioning that the mounting of the second stretcher 1300 is identical to the one of the first stretcher 1200.

In order to mount the stretchers 1200 and 1300 in a symmetrical manner with respect to the patient rotation axis, the stretcher mounting sections 1240, 1250, 1340, and 1350 of the lower and upper stretchers, as well as the stretcher securing means 1440, include alignment and centering members allowing the central longitudinal axis of both stretchers to be placed in a common vertical plane, along with the patient rotation axis X-X' when the stretchers 1200 and 1300 are mounted on the stretcher securing members 1400, achieving in such a manner a perfect balance of stretchers 1200 and 1300 with respect to the patient rotation axis X-X' and the structural base 1100 and facilitating thus the patient 180° rotation.

More particularly, such alignment and centering means are integrated by cooperating cylindrical protrusions 1260 or 1360 (see FIGS. 11 and 14) provided in the middle part of every mounting sections of both stretchers, the protrusions being projected in a perpendicular fashion upwards and downwards the mounting sections, such that they are received in cooperating bores 1447 provided both in the proximal plate 1441 and the distal plate 1443 of every stretcher securing means 1440, as shown in FIGS. 16 and 17.

Another important aspect in the therapeutic bed 1000 of the present invention is that it has been contemplated that every stretcher securing means 1440 further comprises guide means, which initially receive the front or rear mounting section of the stretcher to be mounted. From such a position, the guide means arrive to such a mounting section between the proximal plate 1441 and the distal plate 1143 of the stretcher securing means 1440, where they are firmly mounted upon actuating the closing lever 1444, such means facilitating of course the mounting of the stretchers to be performed by one person alone.

In the specific embodiment of the present invention, such guide means are formed by an intermediate plate 1442 placed between the distal plate 1443 and the proximal plate 1441 which is integrally attached to the latter, such an intermediate plate having a cutout or notch 1446 having a circular path formed on its surface, the cutout 1446 having a closed end in the inner portion of the intermediate plate 1442 and an open end on its edge. On a first section, the stretcher securing member 1440 is rotated by 90° on its mounting axis 1450 (FIGS. 8A and 8B), such that the intermediate plate 1442 is directed towards the inner portion of the bed 1000 to place over it the corresponding mounting section of the stretcher that is being mounted and, at the same time, the corresponding cylindrical protrusion 1260 or 1360 is introduced, which is projected downwards the mounting section at the closed end of such a cutout 1446. Then, in a second operation, the stretcher securing means 1440 is returned to its original position, such that with this movement the protrusion 1260 or 1360 runs along such a cutout 1446 while the mounting section is received at the proximal plate 1441 or distal plate 1443 located under it. In this fashion, once this operation is completed, the mounting sections is placed between the proximal plate 1441 and the distal plate 1443, and the protrusion 1260 or 1360 is introduced in bore 1447 of the plate receiving the mounting section, whereby the plates are ready to be closed using the closing lever 1444.

Figure 19:
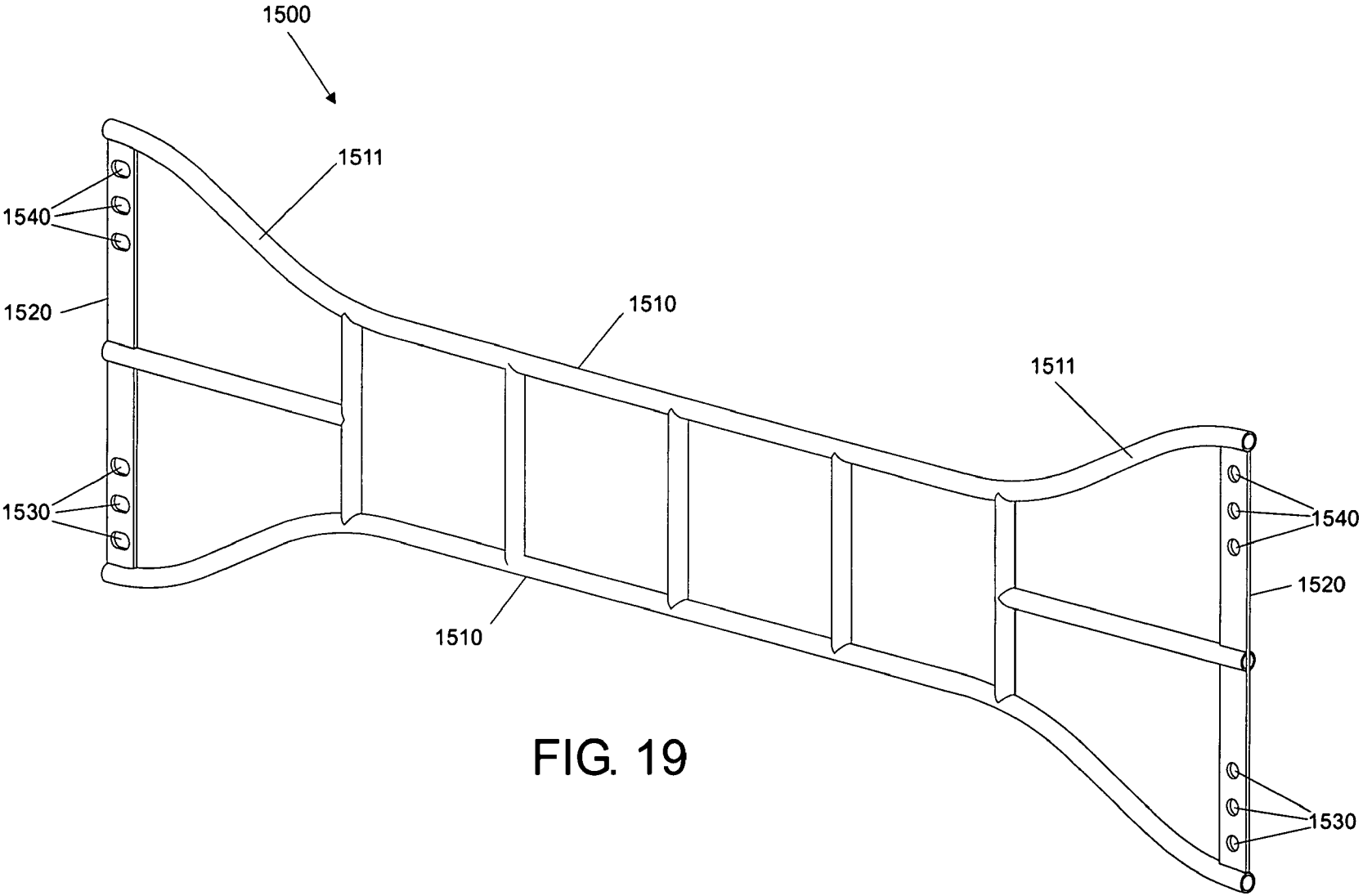
FIG. 19 is a top and side perspective view of one of the side barriers that are part of the rotating therapeutic bed, which is constructed according to the principles of the specific embodiment of the present invention.
Figure 20:
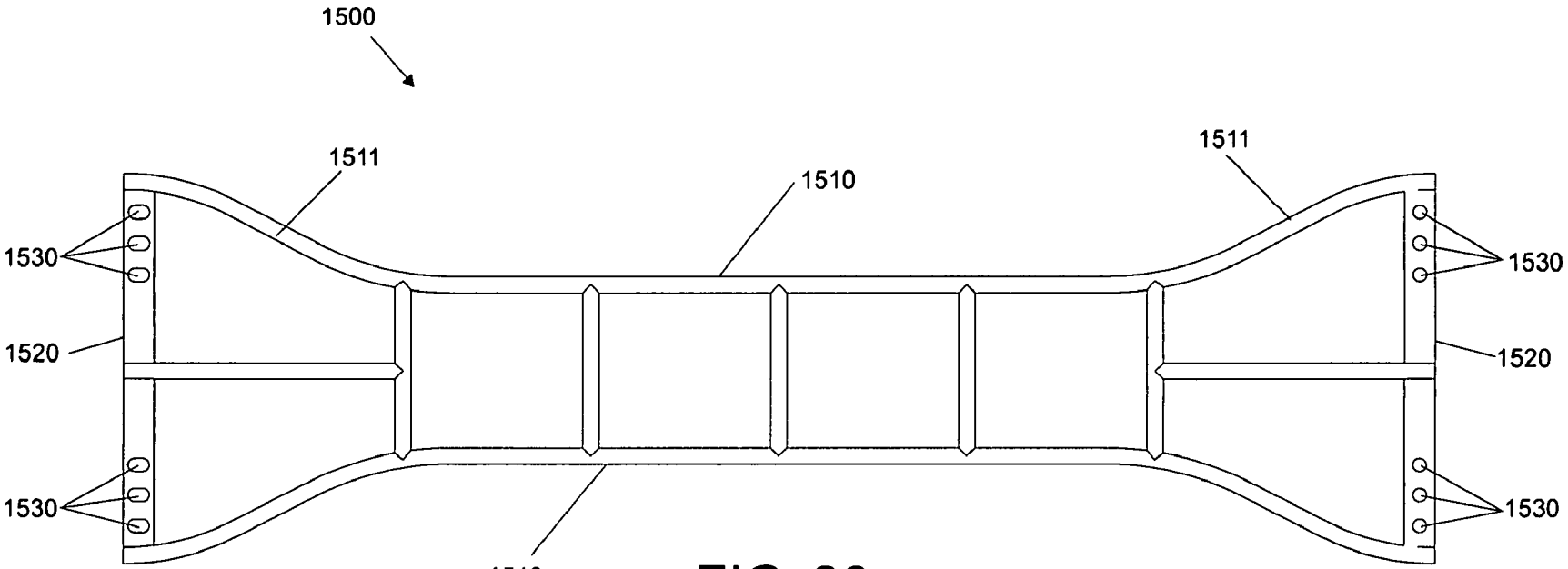
FIG. 20 is an elevated side view of the barrier shown in FIG. 19.

Referring now to FIGS. 19 and 20, they show one of the side barriers 1500 which are part of the therapeutic bed of the present invention, each one of them comprising: an elongated body 1510 with a central section in a rectangular shape and end portions 1511 in a trapezoidal shape. The elongated body ends are provided with vertical bars 1520 including a plurality of lower bores 1530 and upper bores 1540, wherein coupling means are received which are provided in the first and second stretchers and which allow the barrier to be coupled to both stretchers, each one of the lower and upper bores 1530 and 1540 being apart from one another by a vertical distance.

Figure 21:
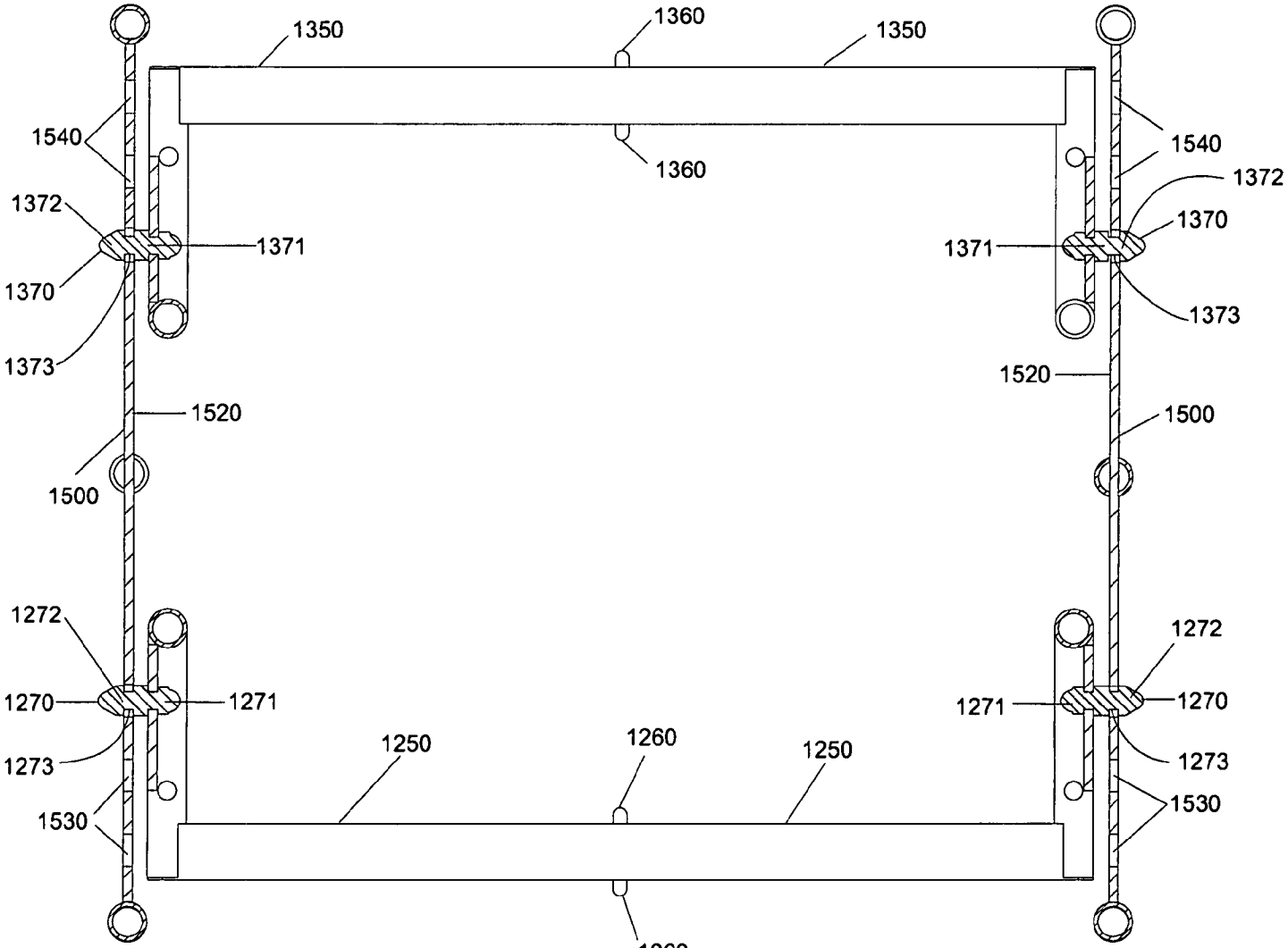
FIG. 21 is a transversal cross-section view taken along the line A-A' of FIG. 1 which shows the coupling of the side barriers and the first and second stretchers.

More specifically and referring to FIG. 21, it may be seen that such coupling means are formed by bolts 1270 or 1370 included on every outer corner of the longitudinal sides of the first stretcher 1200, as well as of the second stretcher 1300. Such bolts cross and protrude from such a plurality of lower bores 1530 and upper bores 1540. In particular, bolts 1270 and 1370 have preferably a cylindrical body 1271 or 1371 having a conical tip 1272 or 1372 and include also a circumferential notch 1273 or 1373 about its middle part, such notch having such a width and deepness that it allows for the width of vertical bars 1520 provided with every lower bore 1530 or upper bore 1540 receiving the bolt 1270 or 1370 to be seated therein, coupling thus the stretcher side barriers.

As for the first and second stretchers 1200 and 1300, the side barriers 1500 are made of metal materials such as aluminum or steel, preferably aluminum due to is low specific weight.

Figure 22C:
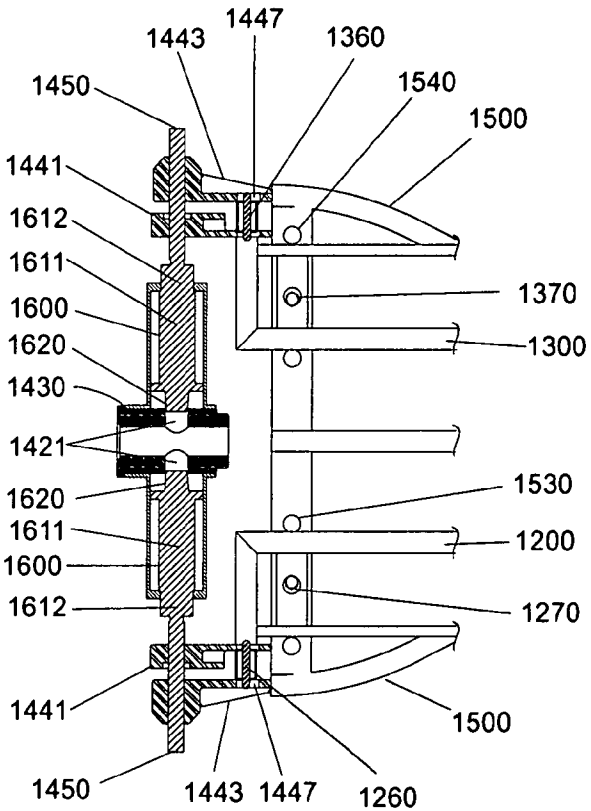
FIGS. 22A to 22C are longitudinal cross-section views taken along the line B-B' of FIG. 1 which shows the assembly sequence of side barriers and the release of the rotation-blocking means internal to the rotating therapeutic bed of the present invention.
Figure 22B:
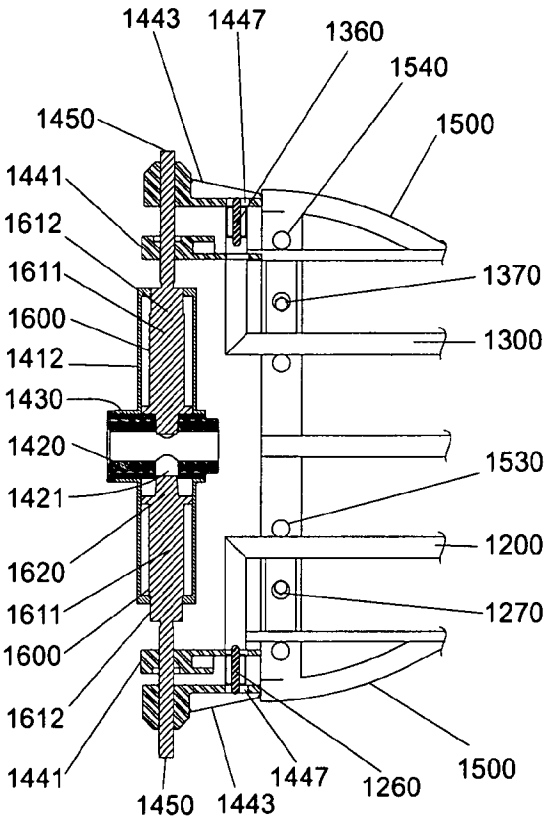
Figure 22A:
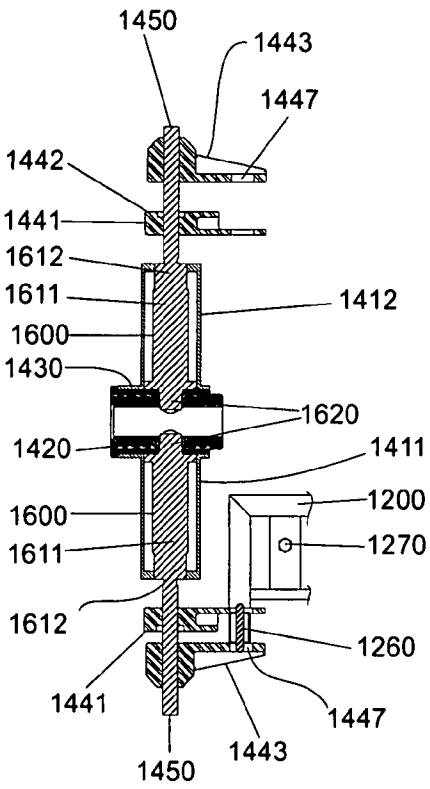

It is now appropriate to specially mention FIGS. 22A to 22C, which represent a cutout taken along line B-B' of FIG. 1 and show de release sequence of the internal rotation means 1600 included in the stretcher mounting and rotation members 1400.

In particular, FIG. 22A shows the first stretcher 1200 which is mounted and secured between the proximal plate 1441 and distal plate 1443 of the stretcher securing means 1440 provided in the first radial section 1411 of the housing of the rear member to support and rotate stretchers 1400. As it can be seen in this figure, internal rotation-blocking means 1600 provided in the first radial section 1411 and the second radial section 1412 are at their blocking position, since the blocking safety device 1620 of every one of them is within one of the cavities 1421 provided in the fixed rotation support axis 1420.

FIG. 22B shows now the second stretcher placed between the proximal plate 1441 and the distal plate 1443 of the member to secure stretchers 1440 before closing the lever 1444. It also shows one of the side barriers 1500 coupled between the first stretcher 1200 and the second stretcher 1300. It should be understood that the other barrier 1500 is also mounted. However, it cannot be appreciated since the figure is a longitudinal cutout.

In this same figure, it may also be seen that the internal rotation-blocking means 1600 provided in the first radial section 1411 where the first stretcher 1200 supporting the patient is located are released by the patient weight. In this sense, it should be understood that the blocking safety device of the front stretcher mounting and rotation member 1400 is also released by the patient weight. Likewise, if the patient were laying face down on the second stretcher 1300, the internal rotation-blocking means 1600 provided in the corresponding radial section 1412 would also be released. More particularly, this figure shows the blocking safety device 1620 outside the corresponding cavity 1421. That is, the internal rotation-blocking means 1600 of the radial sections of the rear and front stretcher mounting and rotation members 1400 where the stretcher on which the patient is laying face down is mounted are released by his weight.

Referring to FIG. 22B, it is seen that the internal rotation-blocking means 1600 provided in the second radial section 1412 is at its blocking position, since the closing lever 1444 has not been actuated to mount the second stretcher 1300.

Upon actuating the lever 1444 that closes the distance between the plates 1441 and 1443 (FIG. 22C), the side barriers 1500 generate an upwards movement of the rotation-blocking means 1600 of such a second radial section 1412, whereby the corresponding blocking safety device 1620 is released when being ejected from the cavity 1421.

In other words, the internal rotation-blocking means 1600 of the radial sections where the stretcher located over the patient is mounted are released upon closing the plates of the stretcher securing members 1440 through the closing lever 1444, provided the side barriers 1500 are coupled to the stretchers, the barriers 1500 generating an upwards movement of the internal rotation-blocking means 1600.

As it may result from all the above, the rotating therapeutic bed 1000 of the present invention has countless advantages. For example, the structural base 1100 has an extremely simple design, but it still able to provide the patient with the Trendelenburg position by internally including stretcher lifting and tilting means. Likewise, one may rapidly mount the stretchers thanks to the guide means which are incorporated to the stretcher securing means. Furthermore, upon performing a 180° rotation on a longitudinal axis of the patient, the one in charge of performing such a rotation applies very little force. Also, the 180° rotation is precise and automatically performed due to the retractile bolt of the external rotation-blocking means 1700. Likewise, since the stretchers are removable, the patient may be carried on any of them regardless if the bed is assembled or not.

Although the above description refers to one specific embodiment of the present invention, it should be emphasized that countless modifications may be performed to such an embodiment without departing from the true scope of the invention, such as how the stretchers are mounted to the support and rotation members, as well as how the side barriers are coupled to the stretchers, or the materials used to manufacture the mattresses. Thus, the present invention should not be limited except for what is established in the state of the art and by the appended claims.

The invention claimed is:

1. A rotating therapeutic bed comprising:

a structural base which in turn includes wheels located at a lower portion of the structural base to allow the bed to be moved from one place to another;

a first removable stretcher having a first mattress to support a patient laying on his back;

a second removable stretcher having a second mattress which is located in a reversed fashion over the first stretcher and over the patient, who is laying between the mattresses of both stretchers, the second stretcher supporting the patient laying face down when the stretchers are rotated by 180° about a rotation axis extending along the patient;

stretcher mounting and rotation members to rotationally mount the stretchers on the structural base, the first and second stretchers being longitudinally mounted with a vertical spacing between them on the stretcher mounting and rotation members, which further allow them to rotate; and side barriers coupled to longitudinal sides of the first stretcher as well as to longitudinal sides of the second stretcher, the barriers covering the vertical spacing between the stretchers where the patient is laying, thereby preventing the limbs of the patient from protruding out of the stretchers when rotated.

2. The rotating therapeutic bed according to claim 1, wherein the structural base comprises:

a front section and a rear section, each formed with a horizontal portion and a vertical portion mounted on the horizontal portion, thereby forming an "L" shape;

an elongated intermediate section longitudinally placed on the lower portion of the structural base and attaching the front section to the rear section; and rear and front support sections for mounting the stretcher mounting and rotation members, the support sections being integrally provided at the upper half of the front section and at the upper half of the rear section, in addition to being perpendicularly provided with respect to the rotation axis about which the patient is rotated by 180°.

3. The rotating therapeutic bed according to claim 2, wherein the structural base is made of metal straight tubular profiles.

4. The rotating therapeutic bed according to claim 2, wherein the structural base includes also a pair of conduits, each conduit being provided on each of the rear and front support sections, crossing the width of each support section from one side to another, the conduits being coaxially lined up with the rotation axis, to introduce traction means for the stretchers, thereby allowing cervical traction therapy of the patient to be performed or, saline solution lines or other lines to be introduced for taking medical care of the patient.

5. The rotating therapeutic bed according to claim 2, wherein the structural base comprises, at an inner portion of the structural base, stretcher lifting and tilting means that are independently provided at the front section, as well as at the rear section, and are actuated in such a manner, on the inner sides of the rear and front sections, to allow the vertical portions to be lifted over the respective horizontal portions, thereby lifting the height of the stretchers, wherein when the stretcher lifting and tilting means act only on the front section or rear section, a plane of the stretcher where the patient is laying is tilted, thereby providing a Trendelenburg position.

6. The rotating therapeutic bed according to claim 1, wherein each of the stretcher mounting and rotation members comprises:

a rotating hollow housing that is divided by a hollow intermediate section having a cylindrical shape, the hollow intermediate section being coaxially lined up to the rotation axis;

a first radial section and a second radial section, both radial sections being hollowed and in a cylindrical shape, which are perpendicularly located with respect to the hollow intermediate section and attached to the hollow intermediate section, the radial sections being further placed in the hollow housing in an opposite manner to each other;

a rotation support axis provided in an inner portion of the intermediate section and securely attached by one of ends of the support axis to the structural base for the rotation of the housing about the support axis;

a bearing placed between the rotation support axis and an inner wall of the intermediate section, allowing a smooth and homogeneous rotation of the housing about the rotation support axis and thus the rotational movement of the stretchers and the patient; and stretcher securing means or jaws provided at a distal portion of each of the first and second radial sections, each of the stretcher securing means or jaws being mounted on a mounting axis coaxially placed in an inner portion of each of the radial sections, the first and second stretchers being mounted on the stretcher securing means.

7. The rotating therapeutic bed according to claim 6, wherein the rotation support axis is formed with a steel tube section and coaxially lined up to the conduits for the introduction of traction means.

8. The rotating therapeutic bed according to claim 6, wherein the bearing is a rotation bearing or bushing made of bronze.

9. The rotating therapeutic bed according to claim 6, wherein the mounting axis of each of the stretcher securing means is threaded at a proximal portion of each of the stretcher securing means with respect to the rotation support axis and is smooth at a distal portion of each of the stretcher securing means, and each of the stretcher securing means comprises:

a proximal plate attached to the threaded portion of the mounting axis and movable along the mounting axis to adjust the height at which the stretchers are mounted with respect to the rotation support axis;

a distal plate apart from the proximal plate and freely slidable on a flat surface of the mounting axis, the distal plate being attached to the proximal plate by means of a connection element; and a closing lever which is operatively attached to the connection element, the closing lever, at a closing position of the closing lever, reducing the spacing between the proximal plate and the distal plate to firmly secure the first stretcher or the second stretcher in such a manner that, with the distance reduction between plates, the stretchers are firmly mounted.

10. The rotating therapeutic bed according to claim 6, wherein each of the stretcher mounting and rotation members further includes a removable stop element placed at a free end of the rotation support axis, which prevents undesired horizontal movements of the housing around the rotation support axis, thereby, when the stop element is removed, allowing the disassembly of the stretcher mounting and rotation members from the structural base.

11. The rotating therapeutic bed according to claim 1, further comprising:

internal rotation-blocking means provided at the inner portion of each of the stretcher mounting and rotation members, which, when being at a blocking position of the internal rotation-blocking means, internally allow a rotational movement of the stretcher mounting and rotation members and prevent the stretchers and the patient from being rotated when the bed is only partially assembled; and external rotation-blocking means provided at the structural base, which, when being at a blocking position of the external rotation-blocking means, externally avoid the rotational movement of at least one of the stretcher mounting and rotation members, thereby preventing the stretchers and the patient from being rotated, wherein the internal and external rotation-blocking means act together so that the rotation of the stretchers is achieved only when the first stretcher and the second stretcher are firmly mounted on the stretcher mounting and rotation members, and only when the side barriers are mounted on the stretchers, whereby the internal rotation-blocking means are automatically released to achieve a 180° rotation of the stretchers upon manually releasing the external rotation-blocking means.

12. The rotating therapeutic bed according to claim 11, wherein the external rotation-blocking means block the rotational movement of the rear stretcher mounting and rotation members.

13. The rotating therapeutic bed according to claim 11, wherein the internal rotation-blocking means are provided in pairs within each of the rear and front stretcher mounting and rotation members, each pair being housed in each of the radial sections.

14. The rotating therapeutic bed according to claim 13, wherein the internal rotation-blocking means comprise:

a main body traveling at the inner part of one of the radial sections of the stretcher mounting and rotation members, the main body being in a cylindrical shape and divided in two sections: a proximal main body portion and a distal main body portion having a diameter smaller than the proximal main body portion, the main body being attached to the mounting axis of the stretcher securing means;

a blocking safety device attached to the proximal main body portion of the main body; and a stop that is secured to the end of one of the radial sections of the stretcher mounting and rotation members, wherein the blocking safety device blocks the rotation of the housing when the blocking safety device is within a cooperating cavity provided on the rotation support axis for each pair of the internal rotation-blocking means, the blocking safety device being released from the cavity when the main body travels within the one of the radial sections a sufficient distance in order for distal the main body portion to protrude from the radial section, the movement being stopped by the stop, which preventing the proximal main body portion from protruding from the housing.

15. The rotating therapeutic bed according to claim 11, wherein the external rotation-blocking means comprise:

a housing attached to the structural base support section; and a retractile bolt crossing the housing from one side to another, wherein, at a blocking position, a first end of the bolt is housed within a first cavity provided in a middle part of the housing of the stretcher mounting and rotation members, whereby the rotational movement of the bolt is externally blocked; and a second end of the bolt is provided with a ring allowing the bolt to be manually moved to remove the first end of the bolt from the first cavity, whereby the bed is free for a 180° rotation.

16. The rotating therapeutic bed according to claim 15, wherein, upon completing the 180° rotation, the first end of the retractile bolt is automatically housed in a second cavity provided in the housing of the stretcher mounting and rotation members in an opposite fashion to the first cavity, whereby the rotational movement is blocked again.

17. The rotating therapeutic bed according to claim 1, wherein, in addition to the first mattress, the first stretcher comprises:

a main frame in a rectangular shape including stretcher mounting sections at front and rear ends of the main frame, which allow the stretcher to be mounted on the stretcher mounting and rotation members;

a cover or coating covering an upper surface of the main frame to secure the first mattress; and a folding section or back support provided as a hinge at a front portion of the stretcher to keep the patient seated on it.

18. The rotating therapeutic bed according to claim 17, wherein the first mattress is divided into a front mattress section moving as a hinge and coincident with the folding section; and a rear mattress section provided with a removable section which, once removed from the first mattress, allows a bedpan to be put in place a in order for the patient to evacuate.

19. The rotating therapeutic bed according to claim 18, wherein the first mattress surface further comprises on it front and rear padded stop sections which are detachably joined or attached as a hinge to the mattress sides by attachment and closing means;

wherein, by being placed on the first mattress, the stop sections form a space between them simulating the patients body contour, thereby preventing the patient from being laterally moved when performing the rotational movement of the stretchers, wherein, likewise, the front and rear stop sections act as a side extension surface of the first mattress when they are moved on the attachment and closing means, the side extension surface being used to place on it light articles or the patient's arms or legs.

20. The rotating therapeutic bed according to claim 19, wherein the attachment and closing means are hook strips and short fibers.

21. The rotating therapeutic bed according to claim 17, wherein the first mattress is coated with a watertight material such as canvas or plastic.

22. The rotating therapeutic bed according to claim 17, wherein the folding section is integrated by:

a secondary frame in a rectangular shape which is attached as a hinge to the main frame of the first stretcher;

a support frame attached as a hinge to a lower portion of the secondary frame and allowing the back support to be kept at the desired position when the frame is supported on the main frame of the first stretcher by means of a horizontal support base; and position selection bars attached to a longitudinal sides of the main frame of the first stretcher, the bars provided with a plurality of position notches where the ends of the support base are received to achieve a desired inclination of the back support.

23. The rotating therapeutic bed according to claim 22, wherein the back support is further provided with back support securing means allowing the back support to be secured to the main frame of the first stretcher in a horizontal position.

24. The rotating therapeutic bed according to claim 23, wherein the securing means is a pin that is introduced in a cooperating notch or recess provided at one of the front lower corners of the main frame of the first stretcher.

25. The rotating therapeutic bed according to claim 17, wherein the stretcher mounting sections are provided in the main frame of the first stretcher in a shape of a horizontal transversal bar.

26. The rotating therapeutic bed according to claim 17, wherein the main frame and the folding section of the first stretcher are made of metal materials such as aluminum or steel.

27. The rotating therapeutic bed according to claim 17, wherein the coating is made of a watertight material such as canvas or plastic.

28. The rotating therapeutic bed according to claim 1, wherein, in addition to the second mattress of the second stretcher, it comprises:

a main frame in a rectangular shape including stretcher mounting sections at front and rear ends of the main frame, which allow the stretcher to be mounted on the stretcher mounting and rotation members;

front, intermediate, and rear coating portions that are apart from each other and that cover most of an upper surface of the main frame, the second mattress being placed on an intermediate and rear coating portion to support most of the patient's body when the patient is laying face down; and a pillow or cushion placed on the front coating portion to support the patient's forehead when the patient is laying face down.

29. The rotating therapeutic bed according to claim 28, wherein the pillow and the front coating portion are respectively apart from the second mattress and from the intermediate coating portion by a distance sufficient to allow the patient to have a free visual field with no interferences when the patient is laying face down.

30. The rotating therapeutic bed according to claim 28, wherein the main frame of the second stretcher is made of metal materials such as aluminum or steel.

31. The rotating therapeutic bed according to claim 28, wherein the coating portions are made of a watertight material such as canvas or plastic.

32. The rotating therapeutic bed according to claim 28, wherein the second mattress and the pillow are coated with a watertight material such as canvas or plastic.

33. The rotating therapeutic bed according to claim 28, wherein the stretcher mounting sections are provided in main frame in a shape of a horizontal transversal bar.

34. The rotating therapeutic bed according to claim 33, wherein the horizontal bar conforming the mounting sections of the first and second stretchers is pressed between the proximal plate and distal plate of a stretcher securing means so that, when the lever of the stretcher securing member is closed, stretchers are firmly mounted by means of the horizontal bar.

35. The rotating therapeutic bed according to claim 34, wherein the mounting sections of the first and second stretchers and the stretcher securing members include alignment and centering means allowing central longitudinal axis of both stretchers to be placed at a common vertical plane, along with the rotation axis, when the stretchers are mounted on the stretcher securing means, achieving thereby a perfect balance of the stretchers with respect to the rotation axis and the structural base, and facilitating the patient 180° rotation.

36. The rotating therapeutic bed according to claim 35, wherein the alignment and centering means are integrated by cooperating cylindrical protrusions provided in a middle portion of each of the mounting sections of both stretchers, the protrusions being perpendicularly projected upwards and downwards from the mounting sections, so that the protrusions are received in corresponding holes provided in the proximal plate and in the distal plate of each of the stretcher securing means.

37. The rotating therapeutic bed according to claim 35, wherein each of the stretcher securing means further comprises guide means to initially receive the front and rear mounting sections of the stretcher to be mounted, wherein, from the position, the guide means arrive at the mounting section between the proximal plate and the distal plate of the stretcher securing means, where the guide means are firmly mounted upon actuating the closing lever.

38. The rotating therapeutic bed according to claim 37, wherein the guide means are formed in an intermediate plate located between the distal plate and the proximal plate and integrally attached to the latter, wherein the intermediate plate has a cutout or notch with a circular path formed from a surface of the intermediate plate, the cutout having a closed end at an inner portion of the intermediate plate and an open end at an edge of the intermediate plate, wherein, in a first operation, the stretcher securing member is rotated by 90° around a mounting axis thereof, so that the intermediate plate is directed towards an inner portion of the bed to place on it one of the mounting sections of the stretchers to be mounted and, at the same time, one of the cylindrical protrusions is introduced, which protrudes downwards from the mounting section at the closed end of the cutout; and subsequently, in a second operation, the stretcher securing means is returned to its original position so that, with this movement, the one of the protrusions runs along the cutout while the mounting section is received at the proximal plate or distal plate under it in order that, once this operation is completed, the mounting section is placed between the proximal and distal plates, and the protrusion is introduced in a plate hole receiving the mounting section, whereby the plates are ready to be closed by means of the closing lever.

39. The rotating therapeutic bed according to claim 1, wherein each of the side barriers comprises:

an elongated body with a central section in a rectangular shape and end portions in trapezoidal shape, wherein the end portions are provided with vertical bars including a plurality of lower and upper bores which receive coupling means provided in the first and second stretchers, thereby allowing the barrier to be coupled to both stretchers, each of the upper and lower bores being apart one from another by a vertical distance.

40. The rotating therapeutic bed according to claim 39, wherein the coupling means are formed by bolts included in each outer corner of the longitudinal sides of the first stretcher and of the second stretcher, the bolts crossing and protruding from the plurality of lower and upper bores.

41. The rotating therapeutic bed according to claim 40, wherein the bolts have a cylindrical body with a conical tip and include a circumferential notch around a middle part of the cylindrical body, the notch having such a width and deepness that the notch supports the width of the vertical bars provided with each of the upper and lower bores receiving the bolt, allowing thereby the side barriers to be coupled to the stretchers.

42. The rotating therapeutic bed according to claim 39, wherein the side barriers are made of metal materials such as aluminum or steel.

43. The rotating therapeutic bed according to claim 13, wherein, at the radial sections of the stretcher mounting and rotation members where the stretcher supporting the patient laying face down is mounted, the rotation-blocking means are released by its weight.

44. The rotating therapeutic bed according to claim 43, wherein the internal rotation-blocking means of the radial sections where the stretcher placed over the patient is mounted are released by closing the levers of the stretcher securing means using the closing lever, provided that the side barriers are coupled to the stretchers, the side barriers generating an upwards movement of the internal rotation-blocking means.

45. The rotating therapeutic bed according to claim 6, wherein the rotation support axis is formed by a steel tube section and coaxially lined up to the conduits for the introduction of traction means.

46. The rotating therapeutic bed according to claim 11, wherein the internal rotation-blocking means are provided in pairs within each of the rear and front members to rotatably mount the stretchers, each pair of the internal rotation-blocking means being housed in each of the radial sections of the housing.

47. The rotating therapeutic bed according to claim 25, wherein the horizontal bar conforming the mounting sections of the first and second stretchers is pressed between the proximal plate and distal plate of a stretcher securing means so that, when the lever of the stretcher securing member is closed, the stretchers are firmly mounted by means of the horizontal bar.

48. The rotating therapeutic bed according to claim 33, wherein the horizontal bar conforming the mounting sections of the first and second stretchers is pressed between the proximal plate and distal plate of a stretcher securing means so that, when the lever of the stretcher securing member is closed, the stretchers are firmly mounted by means of the horizontal bar.

49. The rotating therapeutic bed according to claim 11, wherein the internal rotation-blocking means of the radial sections where the stretcher placed over the patient is mounted are released by closing the levers of the stretcher securing means using the closing lever, provided that the side barriers are coupled to the stretchers, the side barriers generating an upwards movement of the internal rotation-blocking means.

* * * * *